US008787797B2

(12) United States Patent
Melnik et al.

(10) Patent No.: US 8,787,797 B2
(45) Date of Patent: Jul. 22, 2014

(54) PHOTOCONDUCTIVE FOIL SHEET APPLICATOR

(75) Inventors: Michael Melnik, Rehovot (IL); Moshe Peles, Lapid (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 291 days.

(21) Appl. No.: 13/284,921

(22) Filed: Oct. 30, 2011

(65) Prior Publication Data

US 2013/0108323 A1 May 2, 2013

(51) Int. Cl.
*G03G 15/00* (2006.01)

(52) U.S. Cl.
USPC ..... 399/159; 399/1; 399/107; 399/116; 399/130; 399/161; 399/411; 101/477

(58) Field of Classification Search
USPC ..... 399/1, 107, 116, 130, 159, 161, 411
See application file for complete search history.

(56) References Cited

U.S. PATENT DOCUMENTS

| | | | | |
|---|---|---|---|---|
| 3,600,086 | A | 8/1971 | Cates et al. | |
| 3,877,806 | A | 4/1975 | Schrempp et al. | |
| 4,088,403 | A | 5/1978 | Kingsley | |
| 4,231,652 | A | 11/1980 | Moser et al. | |
| 4,477,180 | A | 10/1984 | Bustamante | |
| 4,914,479 | A * | 4/1990 | Ogura et al. | 399/161 |
| 5,400,121 | A | 3/1995 | Foote | |
| 5,403,627 | A | 4/1995 | Wilbert et al. | |
| 5,699,740 | A * | 12/1997 | Gelbart | 101/477 |

FOREIGN PATENT DOCUMENTS

JP 05038800 A * 2/1993

OTHER PUBLICATIONS

JP 05038800 A English Abstract, Mori et al., Feb. 1993.*

* cited by examiner

*Primary Examiner* — Ryan Walsh

(57) ABSTRACT

A photoconductive foil sheet applicator applies a photoconductive foil sheet about a circumference of a drum.

20 Claims, 29 Drawing Sheets

PHOTOCONDUCTIVE FOIL SHEET APPLICATOR

BACKGROUND

Some printing systems print by forming an electrostatic image on a photoconductive foil that is supported by a drum. Toner or ink form an image on the foil based upon the electrostatic charges on the foil. The image of toner or ink is subsequently transferred to a print medium. Manually loading and removing the photoconductive foil may be time-consuming and tedious, and may lead to incorrect installation, resulting in poor print performance, and in some cases, destruction due to poor installation.

DETAILED DESCRIPTION OF THE EXAMPLE EMBODIMENTS

Figure 1:
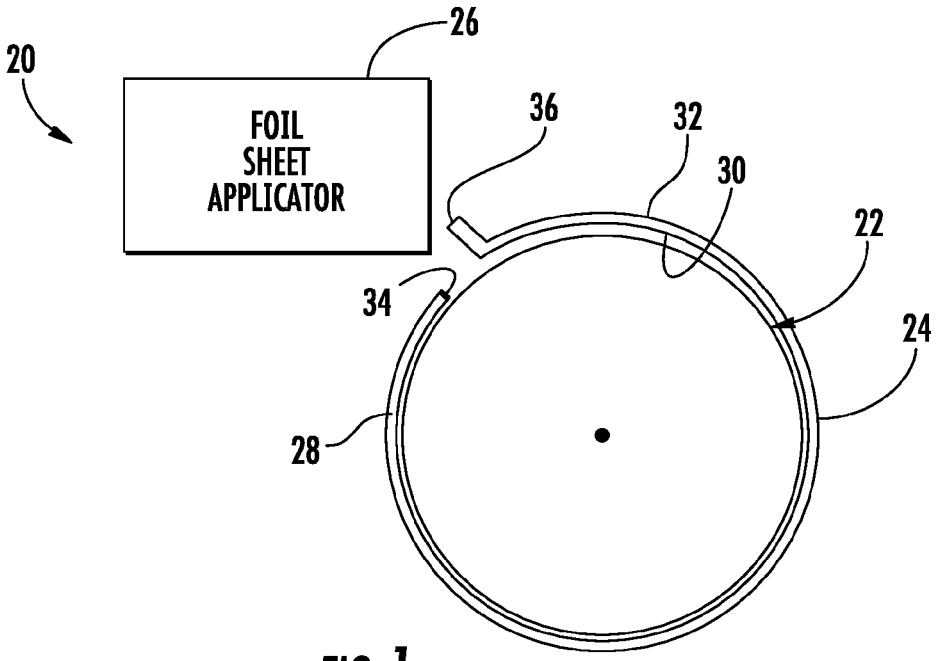
FIG. 1 is a schematic illustration of an example printing system.

FIG. 1 schematically illustrates portions of an example imaging or printing system 20. As will be described hereafter, printing system 20 automatically applies a photoconductive foil sheet, with little or no human manipulations of the sheet, to reduce installation time and cost and to achieve more reliable and accurate positioning of the foil sheet for enhanced print performance. In print operation mode, the printing system 20 comprises drum 22 covered with photoconductive foil sheet 24

Drum 22 comprises a rotatably driven cylindrical member sized to support photoconductive sheet 24 with the photoconductive sheet 24 wrapped about the drum. Photoconductive sheet 24 comprises a foil sheet of photoconductive material which upon being impinged by light, such as a laser light, has areas of different electrostatic charge so as to form an electrostatic image. Photoconductive sheet 24 has opposite side edges 28, and interior face 30 which contacts a circumferential surface of drum 24, an outer surface 32 which is to be impinged by light, a leading terminal edge 34 and a trailing terminal edge 36.

Foil sheet applicator 26 comprises a mechanism to automatically, and with little or no human or manual intervention, apply and wrap sheet 24 about drum 22. Foil sheet applicator 26 is located external to drum 22 and applies the leading edge 34 to drum 22. As the leading edge 34 is held against drum 22, drum 22 is rotatably driven while foil sheet 24 continues to hold a remainder of sheet 24 against drum 23. This results in sheet 24 being wrapped about drum 22 until trailing terminal edge 36 is released and separated from foil sheet applicator 26. Because foil sheet applicator 26 comprises a mechanical device which consistently and reliably applies sheet 24 to drum 22, installation time and cost are reduced and the foil sheet 24 is more accurately and consistently installed for enhanced print performance.

Figure 2:
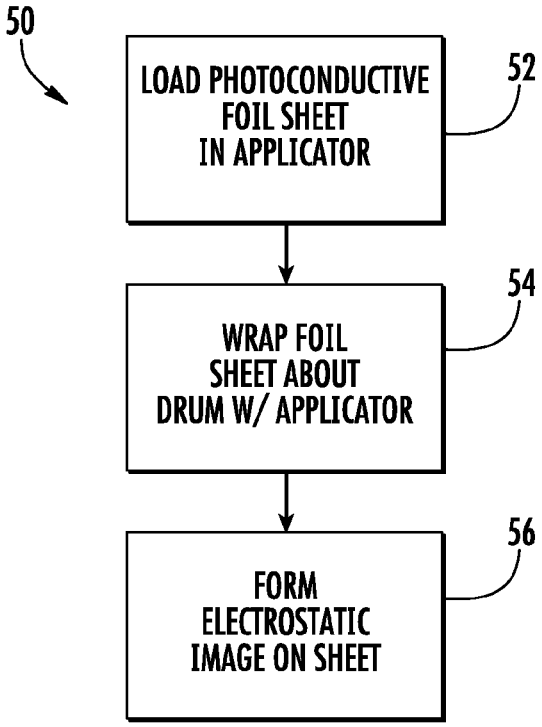
FIG. 2 is a flow diagram of an example method for applying a photoconductive foil sheet to a drum.

FIG. 2 is a flow diagram of an example method 54 installing and utilizing foil sheet 24 on drum 22. As indicated by step 52, photoconductive foil sheet 24 is loaded in foil sheet applicator 26. As indicated by step 54, foil sheet 24 is wrapped about the drum 22 by applicator 26. In particular, foil sheet applicator 26 applies the leading terminal edge 34 to drum 22 and continues to discharge a remainder of sheet 24 while the applicator 26 presses the remainder sheet 24 against drum 22 and while drum 22 is rotated. As indicated by step 56, electrostatic energy suddenly formed upon sheet 23 in carrying out a printing process.

Figure 3:
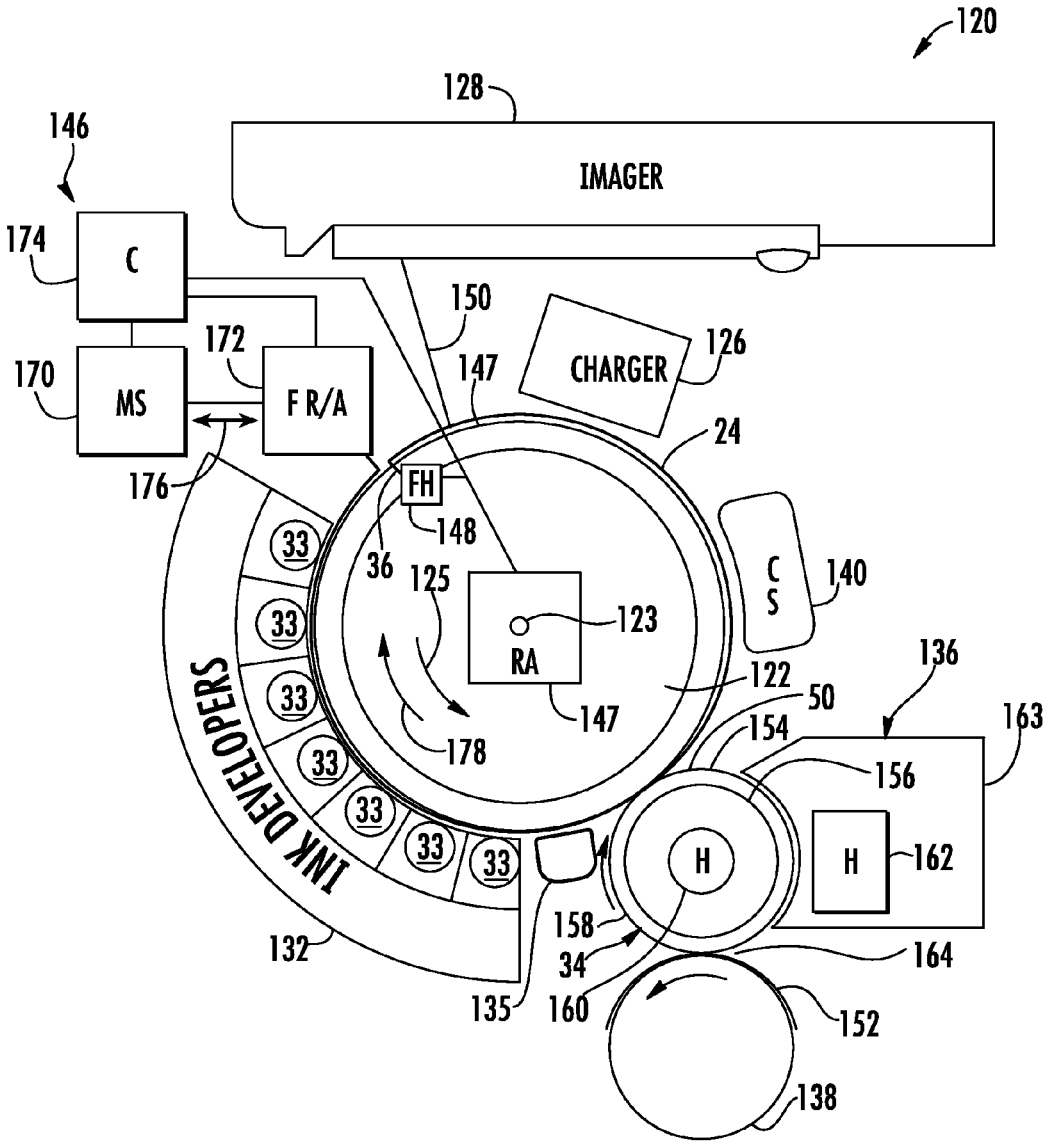
FIG. 3 is a schematic illustration of another example implementation of the printing system of FIG. 1.

FIG. 3 schematically illustrates an example printing system 120, a particular embodiment of printing system 20. In the example implementation illustrated, printer 120 comprises a liquid electrophotographic (LEP) printer. Printer 120, (sometimes embodied as part of an offset color press) includes drum 122, photoconductive foil sheet 24 (described above), charger 126, imager 128, ink carrier oil reservoir 130, ink supply 131, developer 132, internally and/or externally heated intermediate transfer member 134, heating system 136, impression member 138, cleaning station 140 and foil sheet removal/application system 146. As will be described hereafter, cleaning station 140 utilizes vortex flow resisters to facilitate more uniform application of cleaning fluid or liquid to drum 122, reducing temperature variations across drum 122 and enhancing print performance.

Drum 122 comprises a movable support structure supporting photoconductive foil sheet 24. Drum 122 is configured to be rotationally driven about axis 123 in a direction indicated by counter-clockwise arrow 125 by the rotary actuator 147 comprising a motor and transmission (not shown). Drum 122 comprises a foil sheet holder (FH) 148. Foil sheet holder 148 is configured to hold a leading edge 34 of foil sheet 24 as a sheet wrapped about drum 122. In one implementation, foil sheet holder 148 includes grippers that clamp and hold leading edge 136 within and below an external circumferential surface of drum 122. In other implementations, a vacuum or other grouping mechanisms may be utilized to hold and retain leading edge 34 in place as drum 122 is rotated and as a remainder of sheet 24 is wrapped about drum 122. During printing, drum 122 transports distinct surface portions of photoconductive foil sheet 24 between stations of printer 120 including charger 126, imager 128, ink developers 132, transfer member 34 and charger 134.

Charger 126 comprises a device configured to electrostatically charge surface 147 of sheet 24. In one embodiment, charger 126 comprises a charge roller which is rotationally driven while in sufficient proximity to photoconductive foil sheet 24 so as to transfer a negative static charge to surface 147 of photoconductive foil sheet 24. In other embodiments, charging unit 126 may alternatively comprise one or more corotrons or scorotrons. In still other embodiments, other devices for electrostatically charging surface 147 of photoconductive foil sheet 24 may be employed.

Imager 128 comprises a device configured to selectively electrostatically discharge surface 147 so as to form an image. In the example shown, imager 128 comprises a scanning laser which is moved across surface 147 as drum 122 and photoconductive foil sheet 24 are rotated about axis 123. Those portions of surface 147 which are impinged by light or laser 150 are electrostatically discharged to form an image (or latent image) upon surface 147. In other embodiments, imager 128 may alternatively comprise other devices configured to selectively emit or selectively allow light to impinge upon surface 147. For example, in other embodiments, imager 128 may alternatively include one or more shutter devices which employ liquid crystal materials to selectively block light and to selectively allow light to pass to surface 147. In yet other embodiments, imager 128 may alternatively include shutters which include micro or nano light-blocking shutters which pivot, slide or otherwise physically move between a light blocking and light transmitting states.

In one embodiment, the liquid carrier comprises an ink carrier oil, such as Isopar, and one or more additional components such as a high molecular weight oil, such as mineral oil, a lubricating oil and a defoamer. In one embodiment, the printing material, including the liquid carrier and the colorant particles, comprises HEWLETT-PACKARD ELECTRO INK commercially available from Hewlett-Packard.

Ink developers 132 comprises devices configured to apply printing material to surface 147 based upon the electrostatic charge upon surface 147 and to develop the image upon surface 147. According to one embodiment, ink developers 132 comprise binary ink developers (BIDs) circumferentially located about drum 122 and photoconductive foil sheet 24. Such ink developers are configured to form a substantially uniform 6μ thick electrostatically charged layer composed of approximately 20% solids which is transferred to surface 147. In yet other embodiments, ink developers 132 may comprise other devices configured to transfer electrostatically charged liquid printing material or toner to surface 147.

Intermediate image transfer member 134 comprises a member configured to transfer the printing material upon surface 147 to a print medium 152 (schematically shown). Intermediate transfer member 134 includes an exterior surface 154 which is resiliently compressible and which is also configured to be electrostatically charged. Because surface 154 is resiliently compressible, surface 154 conforms and adapts to irregularities in print medium 152. Because surface 154 is configured to be electrostatically charged, surface 154 may be charged so as to facilitate transfer of printing material from surface 147 to surface 154.

Heating system 136 comprises one or more devices configured to apply heat to printing material being carried by surface 154 from photoconductive foil sheet 24 to medium 152. In the example illustrated, heating system 136 includes internal heater 160, external heater 162 and vapor collection plenum 163. Internal heater 160 comprises a heating device located within drum 156 that is configured to emit heat or inductively generate heat which is transmitted to surface 154 to heat and dry the printing material carried at surface 154. External heater 162 comprises one or more heating units located about transfer member 34. According to one embodiment, heaters 160 and 162 may comprise infrared heaters.

Heaters 160 and 162 are configured to heat printing material to a temperature of at least 85° C. and less than or equal to about 140° C. In still other embodiments, heaters 160 and 162 may have other configurations and may heat printing material upon transfer member 134 to other temperatures. In particular embodiments, heating system 136 may alternatively include one of either internal heater 160 or external heater 162.

Vapor collection plenum 163 comprises a housing, chamber, duct, vent, plenum or other structure at least partially circumscribing intermediate transfer member 34 so as to collect or direct ink or printing material vapors resulting from the heating of the printing material on transfer member 34 to a condenser (not shown).

Impression member 138 comprises a cylinder adjacent to intermediate transfer member 134 so as to form a nip 164 between member 134 and member 138. Medium 152 is generally fed between transfer member 134 and impression member 138, wherein the printing material is transferred from transfer member 134 to medium 152 at nip 164. Although impression member 138 is illustrated as a cylinder or roller, impression member 138 and alternatively comprise an endless belt or a stationary surface against which intermediate transfer member 134 moves.

Cleaning station 140 comprises one or more devices configured to remove residual printing material from photoconductive foil sheet 24 prior to surface areas of photoconductive foil sheet 24 being once again charged at charger 126.

In operation, ink developers 132 develop an image upon surface 147 by applying electrostatically charged ink having a negative charge. Once the image upon surface 147 is developed, charge eraser 135, comprising one or more light emitting diodes, discharges any remaining electrical charge upon such portions of surface 147 and ink image is transferred to surface 154 of intermediate transfer member 134. In the example shown, the printing material formed comprises and approximately 1.0μ thick layer of approximately 90% solids color or particles upon intermediate transfer member 134.

Heating system 136 applies heat to such printing material upon surface 154 so as to evaporate the carrier liquid of the printing material and to melt toner binder resin of the color and particles or solids of the printing material to form a hot melt adhesive. The heat applied to surface 154 is inherently transferred to surface 147. Thereafter, the layer of hot colorant particles forming an image upon surface 154 is transferred to medium 152 passing between transfer member 134 and impression member 138. In the embodiment shown, the hot colorant particles are transferred to print medium 152 at approximately 90° C. The layer of hot colorant particles cool upon contacting medium 152 on contact in nip 164.

These operations are repeated for the various colors for preparation of the final image to be produced upon medium 152. As a result, one color separation at a time is formed on a surface 154. This process is sometimes referred to as "multi-shot" process.

After prolonged periods of printing, photoconductive foil sheet 24 may need to be replaced. Foil sheet application system 146 comprises a mechanical system constructed so as to automatically remove an old or used photoconductive foil sheet 24 from drum 122 and so as to automatically apply or install a new photoconductive foil sheet 24 about drum 122. Foil sheet application system 146 automatically removes the old foil 24 and installs the new foil sheet 24 without a person having to manually touch either sheet 24 while either sheet 24 is positioned against drum 24. Foil sheet application system 146 comprises motion system 170, foil sheet remover and applicator 172 and controller 174.

Motion system 170 comprises a system configured to move remover and applicator 172 towards and away from drum 122. In particular, motion system 170 moves remover and applicator 172 in directions indicated by arrows 176 between a foil removing/applying position (shown in FIG. 3) in which applicator 172 applies and presses foil sheet 24 to and against drum 122 and a withdrawn position away from drum 122. In one or more withdrawn positions, used and removed foil sheet 24 may be discharged from applicator 172 and a fresh foil sheet 24 may be loaded into applicator 172. By moving applicator 172 to a withdrawn position, actuator 172 does not interfere with the use of foil sheet 24 during printing.

Foil sheet remover and applicator 172 comprises a mechanism to automatically, and with little or no human or manual intervention: (1) remove a used or damaged photoconductive foil sheet 24 from drum 122 and (2) apply and wrap a fresh photoconductive foil sheet 24 about drum 23. Foil sheet applicator 26 is located external to drum 22 and is moved between the foil applying position and the withdrawn position.

Controller 174 comprises one or more processing units to receive signals from sensors indicating the state of drum 122, motion system 170 and applicator 172. Controller 174 further generates control signals directing the operation of at least the rotary actuator 147, motion system 170 and applicator 172.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 174 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, upon receiving a command to replace an existing photoconductive foil sheet 24 or upon sensing conditions of foil sheet 24 indicating that sheet 24 should be replaced, controller 174, following instructions comprising code stored on a non-transient computer readable medium, generates control signals directing motion system 170 to move applicator 172 to the removing/applying position. Upon receiving signals from one or more sensors indicating that applicator 172 is in the removing/applying position, controller 174 generates control signals directing applicator 172 to grip the existing sheet 24 on drum 122. In one implementation, a vacuum is utilized to grip the existing sheet 24 at its trailing edge. In other implementations, suction cups, clamps or other mechanisms may be used to provide such gripping.

Once the existing sheet 24 has been gripped by applicator 172, controller 174 generates control signals directing rotary actuator 147 to rotate about axis 123 in the reverse, counterclockwise direction indicated by arrow 178. As drum 122 is rotated in direction 178, actuator 172 withdraws the existing sheet 24. In one implementation, remover/applicator 172 includes a roller about which the removed sheet 24 is wound multiple times. In one example implementation, once the existing sheet 24 is wound about the roller, controller 174 generates control signals causing motion system 170 to move applicator 1722 a withdrawn position and then directs aperture 172 unto unwind the roller, unwinding the used sheet 24 into a discharge bin. In other implementation, remover/applicator 172 comprises multiple rollers which tangentially contact and drive the removed sheet 24 away from drum 122 to a discharge bin.

Once the existing sheet 24 has been removed, controller 174 generates control signals directing motion system 170 to move applicator 172 to the removing/applying position once again (if remover/applicator 172 was moved to a withdrawn position for discharging the used sheet 24). Once remover/applicator 172 is in the removing/applying position, controller 174 generates control signals directing remover/chapter 172 to feed a fresh sheet 24 carried by applicator 172 towards drum 122 such that the leading edge 34 of the fresh sheet 24 is engaged by foil holder 148. Controller 174 generates control signals directing foil holder 148 to grip and hold leading edge 36 or portions of sheet 24 proximate to leading edge 36.

Once the fresh sheet 24 has been gripped by holder 148, controller 174 generates control signals directing remover/applicator 172 to reinitiate the release and feeding of the fresh sheet 24. At the same time, controller 174 generates control signals causing rotary actuator 147 to rotate in a forward direction as indicated by arrow 125. As the leading edge 34 is held in place, drum 22 is rotatably driven while remover/applicator 172 continues to hold a remainder of sheet 24 against drum 122. This results in sheet 24 being wrapped about drum 122 until trailing terminal edge 36 is released and separated from remover/applicator 172. Because foil sheet applicator 26 comprises a mechanical device which consistently and reliably applies sheet 24 to drum 122 installation time and cost are reduced and the foil sheet 24 is more accurately and consistently installed for enhanced print performance.

Figure 4:
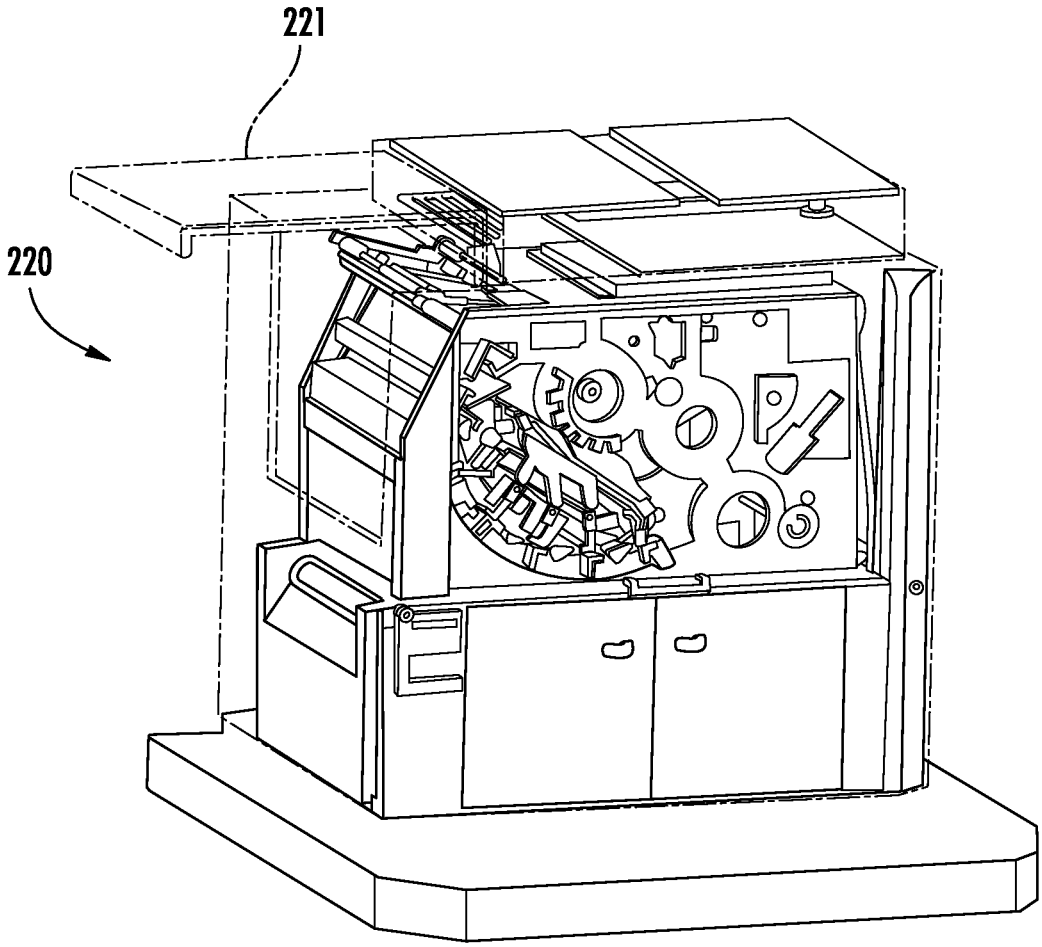
FIG. 4 is a top perspective view of an example implementation of the printing system of FIG. 3 with portions shown as transparent.
Figure 5:
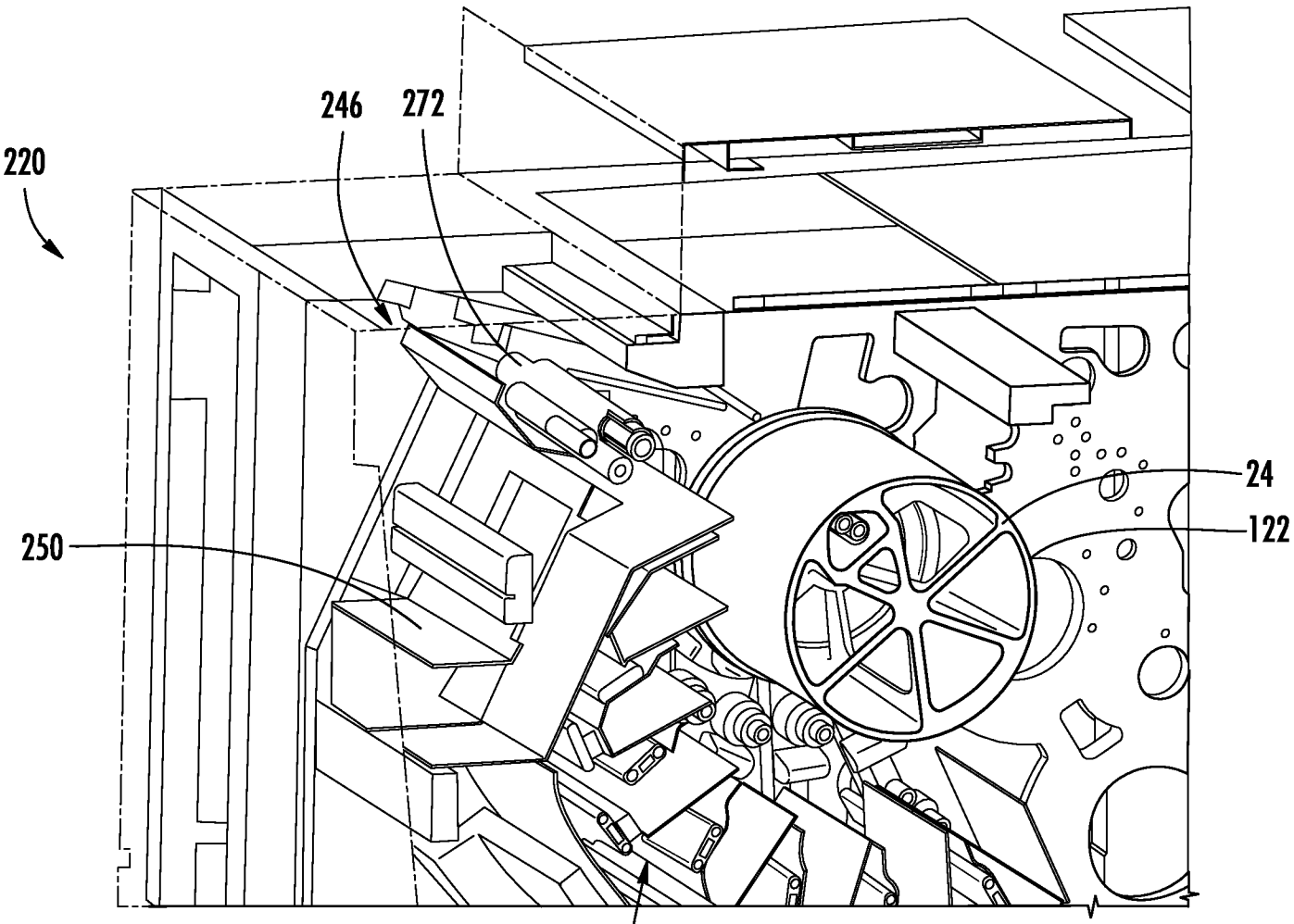
FIG. 5 is an enlarged fragmentary top perspective view of the example printing system of FIG. 4.

FIGS. 4-31 illustrates printing system 220, a particular implementation of printing system 120 shown in FIG. 3. FIG. 4 illustrates printing system 220 with an access door 221 open for access and with portions transparent for purposes of illustration. As shown by FIGS. 4 and 5, printing system 220 generally comprises drum 122, photoconductive foil sheet 24, charger 126, imager 128, ink carrier oil reservoir 130, ink supply 131, developer 132, internally and/or externally heated intermediate transfer member 134, heating system 136, impression member 138, cleaning station 140 and foil sheet removal/application system 246. Each of drum 122, photoconductive foil sheet 24, charger 126, imager 128, ink carrier oil reservoir 130, ink supply 131, developer 132, internally and/or externally heated intermediate transfer member 134, heating system 136, impression member 138, and cleaning station 140, shown and described above with respect to FIG. 3.

Figure 6:
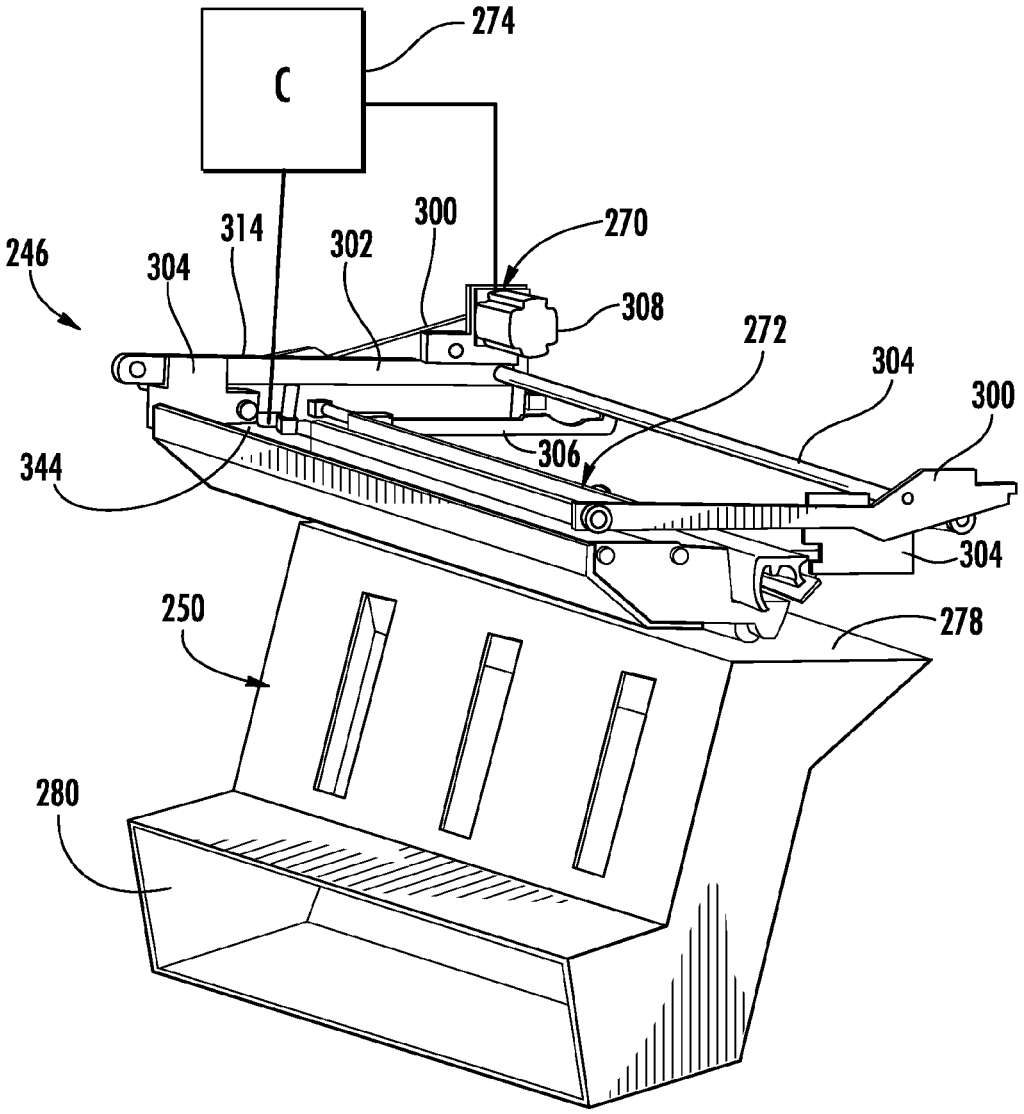
FIG. 6 is a perspective view of an example foil sheet removal/application system of the printing system of FIG. 5.

FIG. 6 illustrates foil sheet removal/application system 246 in detail. As shown by FIG. 6, system 246 comprises discharge or trash bin 250, motion system 270, photoconductive foil sheet remover/applicator 272 and controller 274. Trash bin 250 comprises a container having an upper chute opening 278 to receive used foil sheets 24 from remover/applicator 272 when remover/applicator 272 is in a withdrawn discharging position. Trash bin 250 further includes an outlet opening 280 through which a person may empty waste foil sheets 24 from bin 250. In the implementation illustrated, as in the described hereafter, bin 250 also collects a backing sheet from a fresh foil sheet 24 after it has been applied to drum 122.

Figure 7:
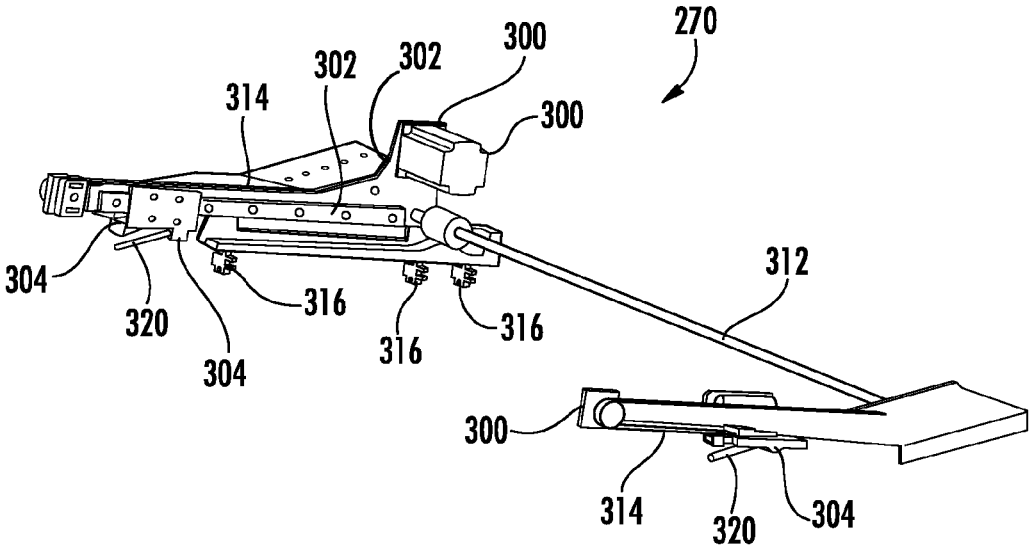
FIG. 7 is a perspective view of an example motion system of the foil sheet removal/application system of FIG. 6.
Figure 8:
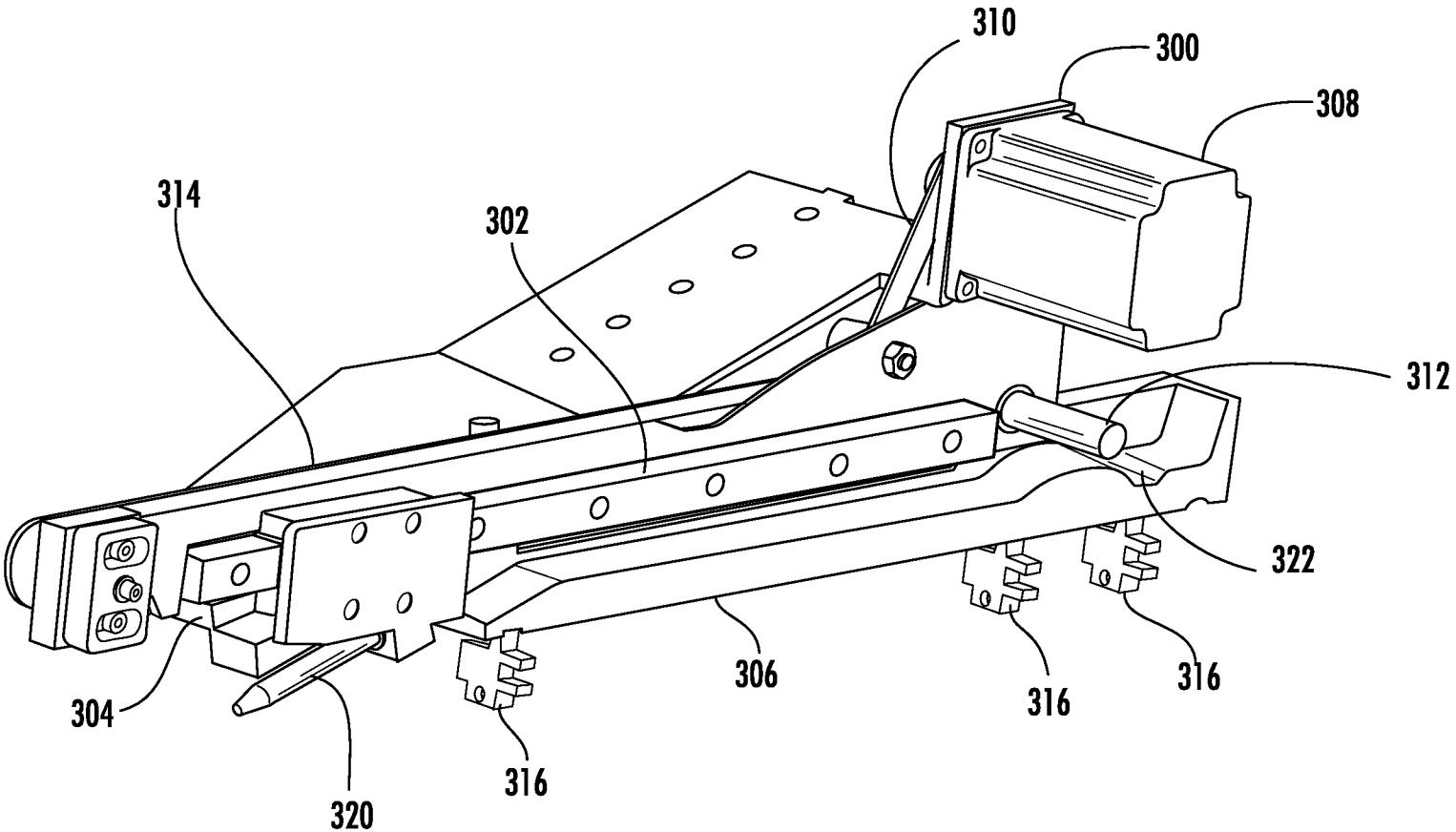
FIG. 8 is an enlarged sectional view of the motion system of FIG. 7.

FIGS. 7 and 8 illustrate motion system 270 in more detail. As shown by FIG. 7, in the example implementation, motion system 270 comprises base 300, left and right linear guides 302, left and right shuttle adapters 304, cam guide 306, step motor 308, drive belt 310, drive shaft 312, left and right shuttle belts 314 and photo micro sensors 316. Base 300 comprises a frame supporting the remaining components of motion system 270. Left and right linear guides 302 comprise rods, bars, tracks, tongues, grooves or other projections supported by base 300 and configured to guide linear movement of left and right shuttle adapters 304, respectively.

Left and right shuttle adapters 304 comprise adapters configured to removably mount foil remover/applicator 272 which is constructed as a shuttle that is carried along linear guides 302. In the example implementation, each shuttle adapters 304 includes a bayonet 320 adapted to fit into a corresponding opening in the remover/applicator 272. In other implementations, remover/applicator 272 may removably mount to shuttle adapters 304 in other manners. In yet other implementations, remover/applicator 272 may alternatively be fixed to shuttle adapters 304.

Cam guide 306 extend to one side of base 300 and includes a cam surface 322 upon which a cam follower associate with remover/applicator 272 rides to raise and lower portions of remover/applicator 272 relative to drum 122. In other implementations, cam guide 206 may have other configurations or may be omitted.

Step motor 308, drive belt 310, drive shaft 312 and shuttle belts 314 cooperate to drive shuttle adapters 304 along linear guides 302 to move remover/applicator 272 towards and away from drum 122 (shown in FIG. 5). Step motor 308 is supported by base 300 and drives drive belt 310. Drive belt 310 is connected to a pulley (not shown) which is fixed to drive shaft 312. Drive shaft 312 includes a pair of pulleys on opposite ends connected to shuttle belts 314 which are fixed to shuttle adapters 304. Step motor 308 drives shuttle belts 314 to selectively move shuttle adapters 304 and remover/applicator 272 along linear guides 302 and along cam guide 306. Photo micro sensors 316, located along cam guide 306, sense the positioning remover/applicator 272 along cam guide 306. In other implementations, other mechanisms may be used to linearly translate shuttle adapters 304 and foil remover/applicator 272.

Figure 9:
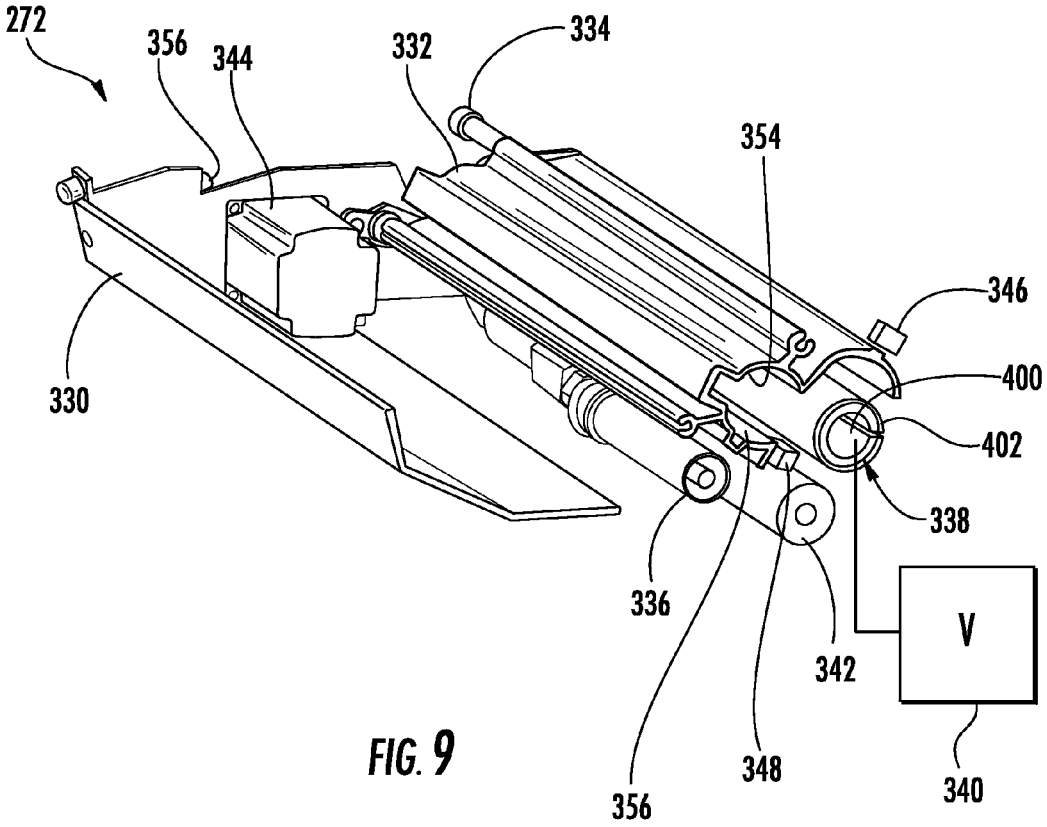
FIG. 9 is a perspective view of an example foil sheet remover/applicator of the foil sheet removal/application system of FIG. 6.
Figure 10:
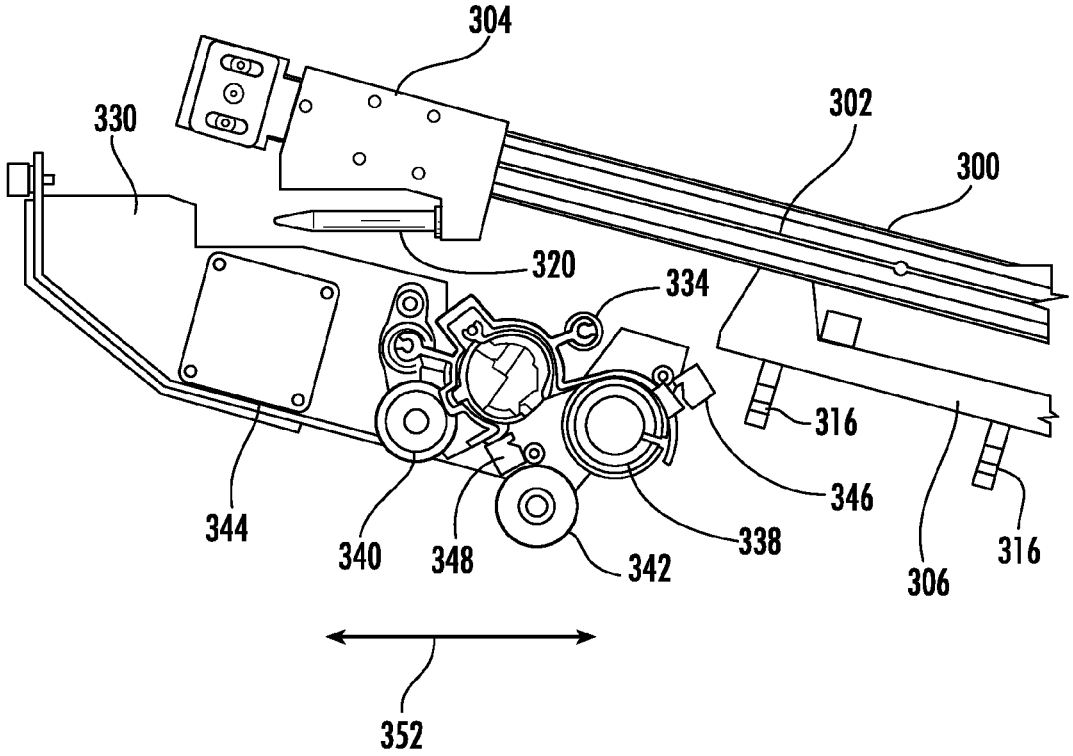
FIG. 10 is a sectional view of the foil sheet remover/applicator of FIG. 9 being installed on the motion system of FIG. 7.

FIGS. 9 and 10 are sectional views illustrating foil remover/applicator 272 removed from motion system 270. As shown by FIG. 9, foil remover/applicator 272 comprises frame 330, cam follower 332, capsule chamber 334, capsule 335, capsule loader-unloader 336, pick up roller 338, vacuum source 340, ironing or pressing roller 342, step motor 344, and optical sensors 346, 348. Frame 330 supports the remaining components of foil remover/applicator 272. Frame 330 includes an aperture or bore 350 on left and right sides to receive bayonets 320 of shuttle adapters 304. Foil remover/applicator 272 is inserted onto and removed from shuttle adapter 304 by movement in the directions indicated by arrow 352 in FIG. 10. In other implementations where foil remover/applicator 272 is mounted to shuttle adapters 304, frame 330 may have other configurations.

Cam follower 332 comprise a cam member extending from capsule chamber 332 that is configured to roll along cam surface 322 of cam guide 306 shown in FIG. 8. In the illustrated implementation, cam follower 334 comprises a roller. In other implementations, cam follower 332 may have other configurations. For example, in other implementations, cam follower 334 may extend from other structures, such as frame 330. In some implementations, motion system 270 may include both left and right cam guides 306, wherein foil remover/applicator 272 includes left and right cam followers 334.

Capsule chamber 334 comprises an elongate cylindrical cavity or chamber that is shaped and sized to receive a new or fresh foil sheet containing capsule 335 (shown in FIGS. 10-12) through an opening 354, wherein capsule chamber 332 sufficiently surrounds the foil capsule to inhibit sideways or lateral withdrawal of the foil capsule, but provides a lateral or side opening 356 through which the foil sheet in the capsule may be unwound and withdrawn from the foil capsule. Depending upon the configuration of the capsule, capsule chamber 332 may have other sizes and shapes.

Figure 12:
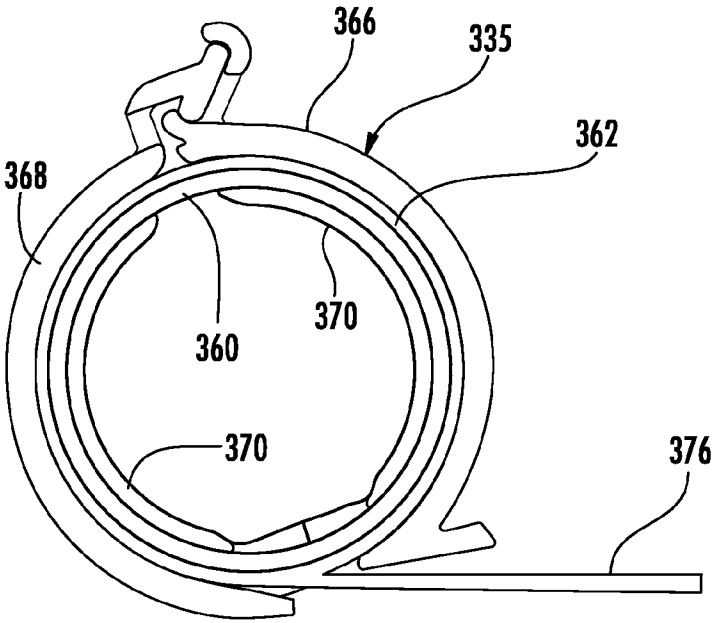
FIG. 12 is a sectional view of the FIG. 11 containing an example backing sheet and an example photoconductive foil sheet.
Figure 11:
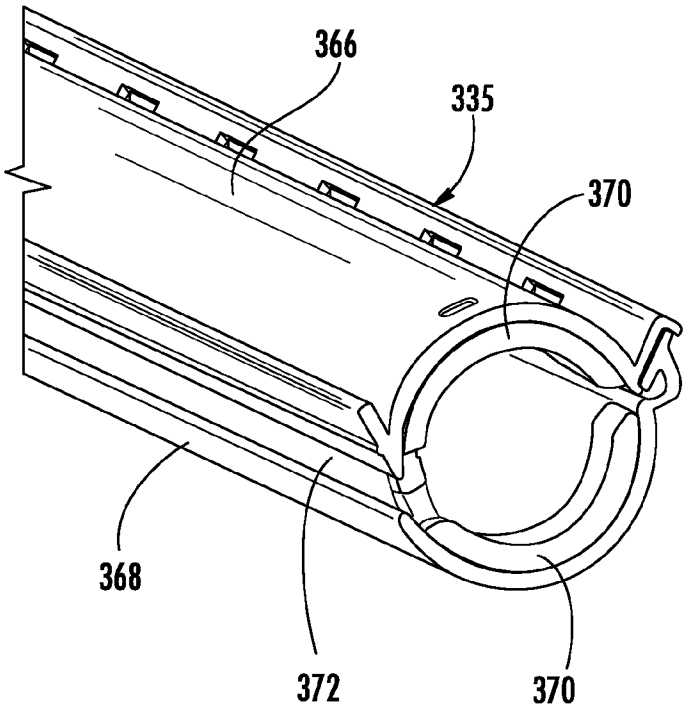
FIG. 11 is a fragmentary perspective view of an example capsule of the printing system of FIG. 4.

FIGS. 11 and 12 illustrate capsule 335. FIG. 12 further illustrates photoconductive foil sheet 360 and backing 362 within capsule 335. Capsule 335 comprises an elongate tubular member configured to receive and contain foil sheet 360 and backing 362 in a rolled up configuration. In the example implementation, capsule 335 comprises a pair of clamshell halves 366, 368 joined together. Each clamshell half 366, 368 includes an associated side limiter 370 configured to axially contain a rolled up foil sheet 360 and backing 362 within capsule 335. When clamshell halves 366 and 360 and are joined together, they form a transverse discharge opening 372 through which foil sheet 360 and backing sheet 362 may be withdrawn from capsule 335.

Photoconductive foil sheet 360 comprises a foil sheet of photoconductive material which upon being impinged by light, such as a laser light, has areas of different electrostatic charge so as to form an electrostatic image. As with photoconductive foil sheet 24 (shown in FIG. 1), photoconductive foil sheet 24 has opposite side edges, an interior face which contacts a circumferential surface of drum 122, an outer surface which is to be impinged by light, a leading terminal edge and a trailing terminal edge.

Backing sheet 362 comprises a photoconductive foil sheet carrier formed from paper or other cellulose-based material and releasably adhered to the interior face of sheet 360 by pressure sensitive adhesive. As shown by FIG. 12, backing sheet 362 has a leading edge portion 376 extending beyond foil sheet 360, wherein backing sheet 362 is positioned within capsule 335 such that leading edge portion 376 projects through discharge opening 372 and beyond discharge opening 372 prior to any unwinding of foil sheet 360 or backing sheet 362 from capsule 335. As will be described hereafter, leading edge portion 376 facilitates the withdrawal of backing sheet 362 and from capsule 335. When within capsule 335, backing sheet 362 and foil sheet 360 are wound into a cylinder or tube, the each sheet wound about itself multiple times or cylindrical wraps.

Figure 13:
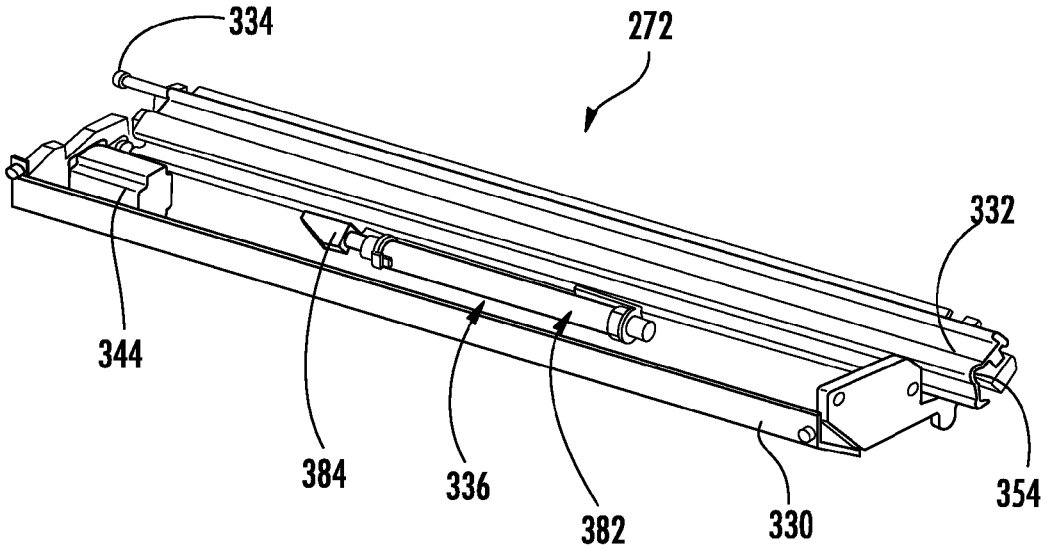
FIG. 13 is a perspective view of the foil sheet remover/applicator of FIG. 9 illustrating an example capsule loader/unloader.
Figure 14:
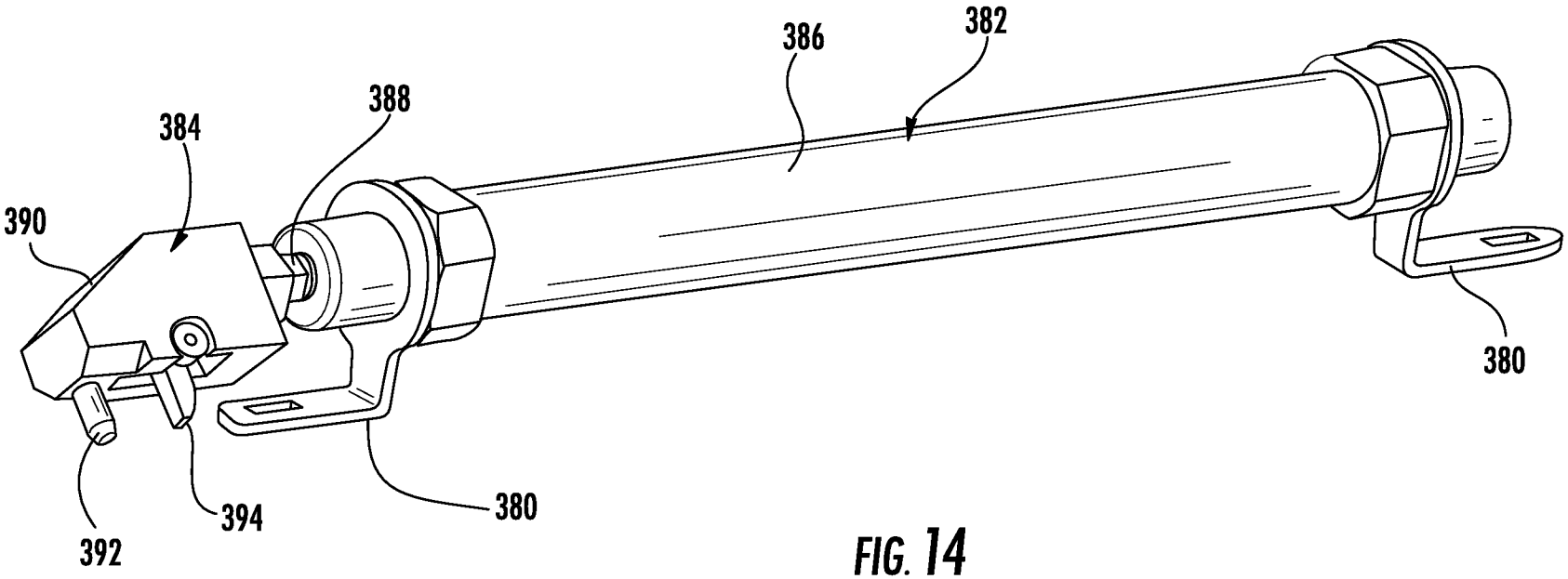
FIG. 14 is an enlarged perspective view of the loader/unloader of FIG. 13.

Capsule loader/unloader 336 comprise a mechanism to complete the insertion of capsule 335 into capsule chamber 332 and to initiate the withdrawal of capsule 335 from capsule chamber 332. Capsule loader/unloader 336 assists in ensuring that capsule 335 is fully and properly inserted and loaded or is properly withdrawn and extracted from capsule chamber 332. FIGS. 13 and 14 illustrate capsule loader/unloader in more detail. As shown by FIG. 14, capsule loader/unloader 336 comprises mounting brackets 380, cylinder-piston assembly 382 and latch assembly 384.

Brackets 380 mount cylinder-piston assembly 382 adjacent to capsule chamber 332. In other implementations, cylinder-piston assembly 382 may be mounted to other structures such as frame 330.

Cylinder-piston assembly 382 comprises a cylinder 386 supported by brackets 380 and a piston 388 coupled to latch assembly 384. Cylinder-piston assembly 32 linearly moves latch assembly 384 while latch assembly 384 is latched to capsule 335 to move capsule 335 during insertion or extraction. In one implementation, cylinder-piston assembly 382 comprises a pneumatic cylinder-piston assembly. In another implementation, cylinder-piston assembly 382 comprises a hydraulic cylinder-piston assembly. In yet other implementations, other linear actuators, such as electric solenoids, may be utilized to move latch assembly 384.

Latch assembly 384 comprises a mechanism that releasably latches onto cartridge 335 during insertion completion or extraction initiation. Latch assembly 384 comprises body 390, stopper 392 and latch 394. Body 390 extends from piston 388 and supports stopper 392 and latch 394. Stopper 392 provides a stop surface against which capsule 335 is initially inserted, indicating to a person that capsule 3305 has been sufficiently inserted to a point where the remaining insertion may be taken over by loader/unloader 336. Stopper 392 further provides a pushing surface configured to push an end of capsule 335 upon actuation of cylinder-piston assembly 382 to initiate extraction of capsule 335 to a point where the remaining extraction of capsule 335 may be manually performed.

Latch 394 comprises a finger or other projection pivotably supported by body 390 so as to withdraw out of engagement with capsule 335 during capsule extraction and so as to latch into engagement capsule 335 during insertion completion. The operation of loader/unloader 336 will be described hereafter respect to FIGS. 19-21. In other implementations, loader/unloader 336 may other configurations or may be omitted.

Referring back to FIG. 9, pickup roller 338 comprises a roller operably coupled to step motor 344 for being rotationally driven by step motor 344. Pickup roller 338 comprises an internal pneumatic passageway 400 and one or more vacuum openings 402. Pneumatic passageway 400 extends into pneumatic communication with vacuum source 340. Vacuum openings 402 are in communication with pneumatic passage 400. Vacuum source 340 (schematically shown in FIG. 9) supplies a vacuum through passage 402 openings 402. As will be described hereafter, the vacuum applied through openings 402 assists pick of roller 338 in (1) gripping of leading-edge 376 of backing sheet 362 during application of foil sheet 360 to drum 122 and (2) gripping a trailing edge of an existing foil sheet 360 being withdrawn from drum 122. In other implementations, additional or alternative techniques may be employed to grip backing sheet 362 and an existing foil sheet 360 during application and removal.

Pressing roller 342 comprises a roller rotationally supported by frame 330. In the example implementation illustrated, pressing roller 342 is an idler roller, merely rotating as a result of forces applied to a circumferential surface of the roller. Pressing roller 342 presses foil sheet 360 against drum 122 as it is being applied to drum 1222 flatten foil sheet 360 against drum 122 and to inhibit the formation of pockets.

Step motor 344 comprises a motor operably coupled to pick roller 338 to rotationally drive pickup roller 338 in response to control signals from controller 274 (shown FIG. 6). In one implementation, step motor 344 may be operably coupled to pick roller 338 by a transmission comprising a gear train. In other implementations, step motor 344 may be operably coupled to pick up roller 338 by other types of transmissions, such as belt and Pulley transmissions, chain and sprocket transmissions and the like.

Optical sensor 346 comprises an optical sensor supported at a location to sense a leading edge of foil sheet 360 during withdrawal of foil sheet 360 from capsule 335 during application of foil sheet 360 to drum 122. Optical sensor 348 comprises an optical sensor supported at a location to sense a trailing edge of backing sheet 362 during discharge of backing sheet 362 in the trash bin 250 (shown in FIG. 6) or a trailing edge of a foil sheet 360 that has been removed from drum 122 and is being discharged in the trash bin 250. In other implementations, other sensing devices may be employed.

Controller 274 comprises one or more processing units configured to receive signals from photo micro sensors 316 (shown in FIG. 8) and optical sensors 346, 348 (shown in FIG. 9). Controller 274 is further configured to generate control signals, according to instructions contained in a non-transient computer readable medium, that direct the operation of rotary actuator 147 to control the rotation of drum 122, that direct the operation of step motor 308 of motion system 270 and step motor 344 of remover/applicator 272, and that control the operation of cylinder-piston assembly 382 of load/unloader 336.

Figure 15:
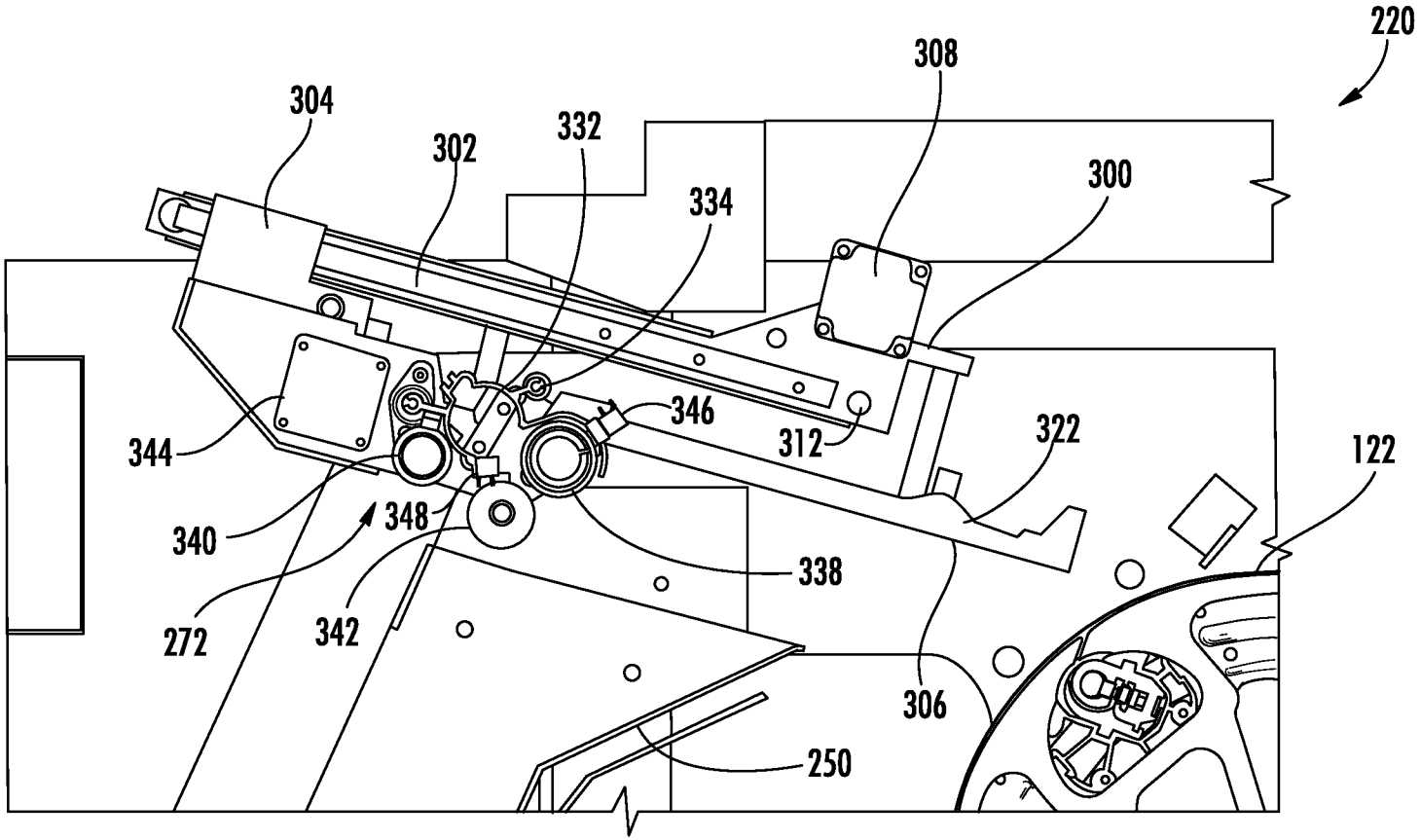
FIG. 15 is a sectional view of the foil sheet remover/applicator in an example parking position.
Figure 16:
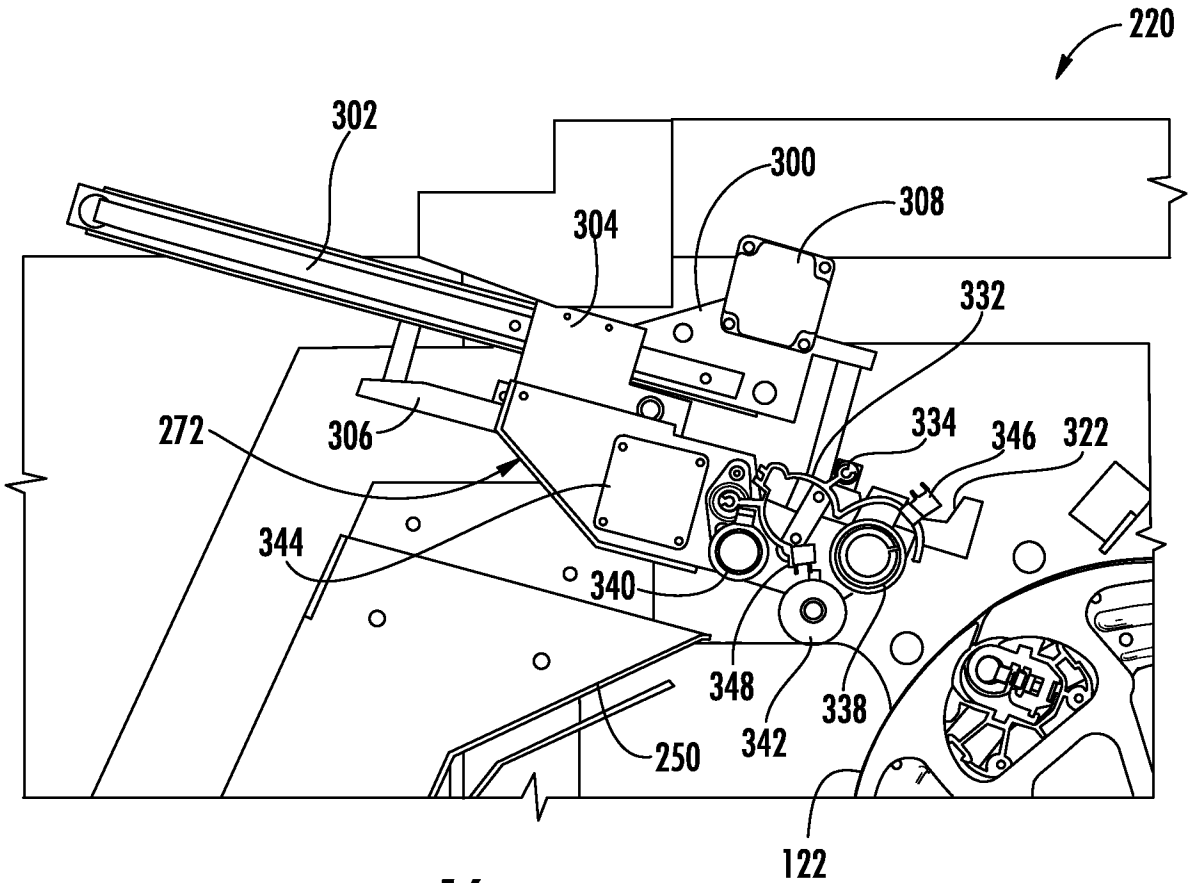
FIG. 16 is a sectional view of the foil sheet remover/applicator in an example capsule loading position.

FIGS. 15-20 illustrate an example of an operation for loading a foil filled capsule 335. FIG. 15 illustrates foil remover/applicator 272 in a parking position withdrawn from drum 122. In the illustrated parking position, foil remover/applicator 272 may be removed from motion system 270 and withdrawn from printing system 220 through the open door shown in FIG. 5. As shown by FIG. 16, to facilitate loading of capsule 335, controller 274 generates control signals directing step motor 308 to drive shuttle belts 314 to move remover/applicator 272 from the parking position to a capsule loading position shown in FIG. 16 as indicated by sensors 316.

Figure 17:
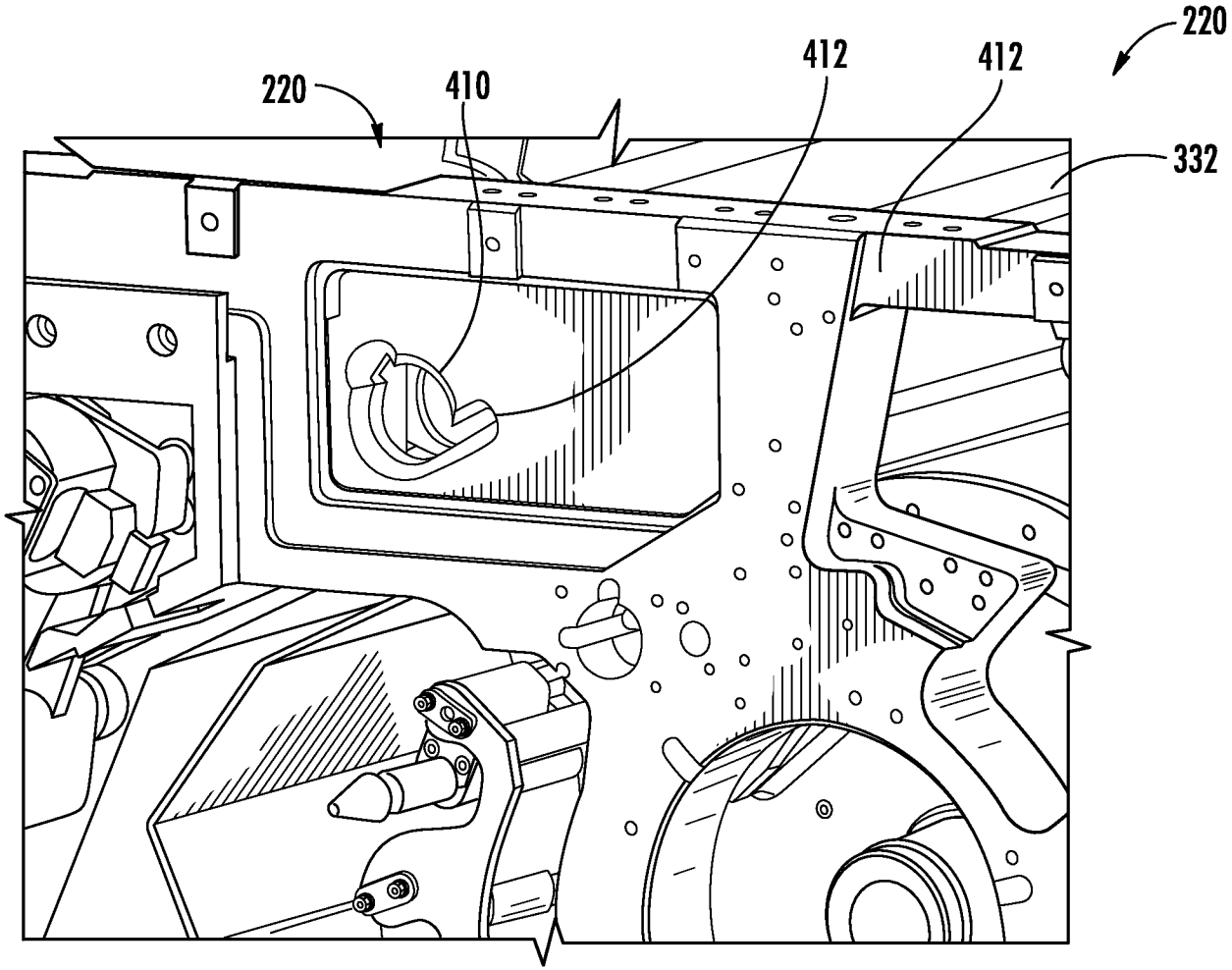
FIG. 17 is a fragmentary perspective view of the printing system of FIG. 4 illustrating an example capsule guide opening.
Figure 18:
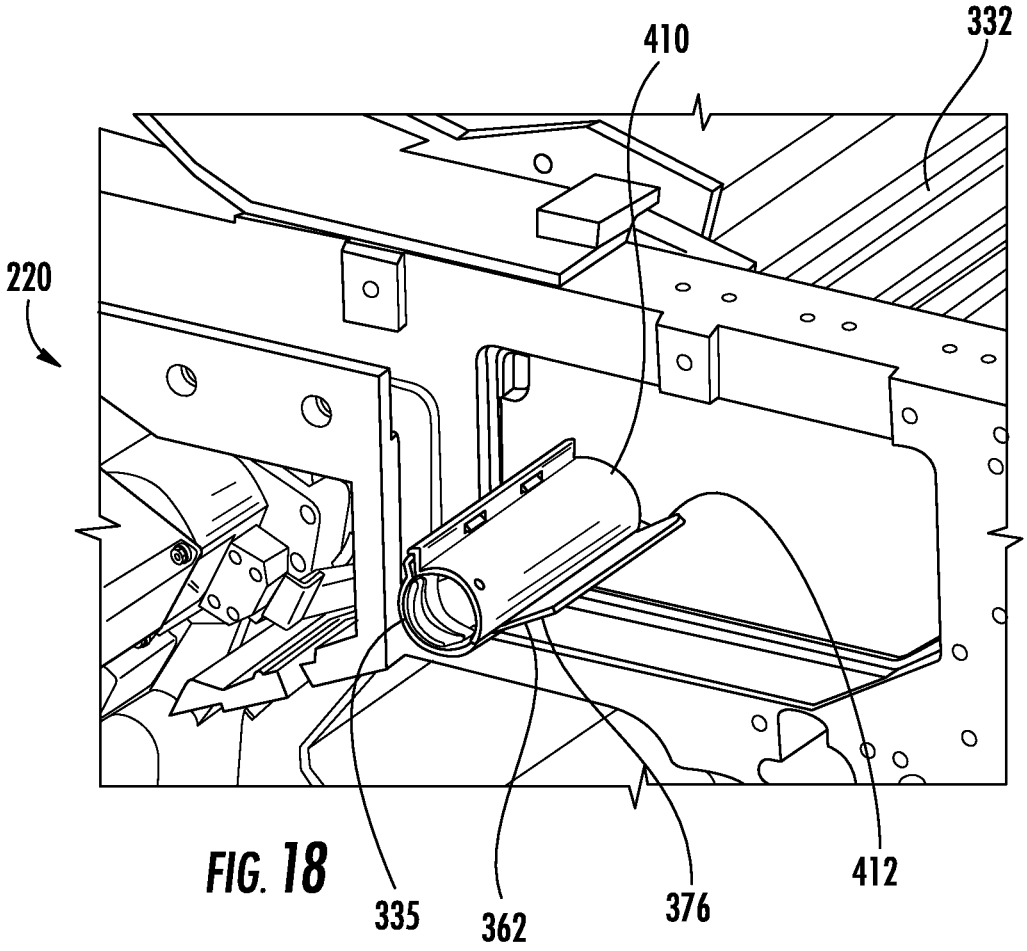
FIG. 18 is a fragmentary perspective view of the printing system of FIG. 4 illustrating partial insertion of the capsule of FIG. 11 through the capsule guide opening.

As shown by FIG. 17, when in the capsule loading position, opening 354 of capsule chamber 332 is aligned with and extends opposite to capsule guide opening 410 formed in a front wall 412 along a side of printing system 220. As shown by FIG. 18, capsule 335 is partially inserted through opening 410 with leading edge 376 of backing sheet 362 extending through a correspondingly shaped extension portion 412 of opening 410. Opening 410 indicates the proper orientation and guides insertion of capsule 335 to ensure that leading edge 376 is properly located for the withdrawal of backing sheet 362 and foil sheet 360 from capsule 335.

Figure 19:
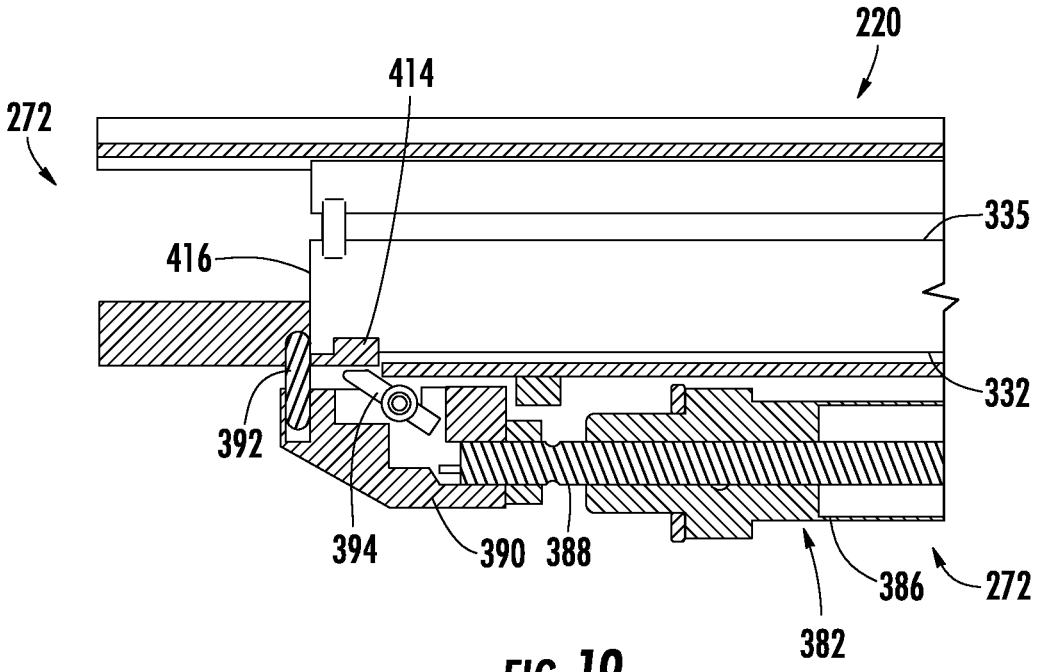
FIG. 19 is a sectional view of the capsule loader/unloader of FIG. 13 upon partial insertion of the capsule as shown in FIG. 18.
Figure 20:
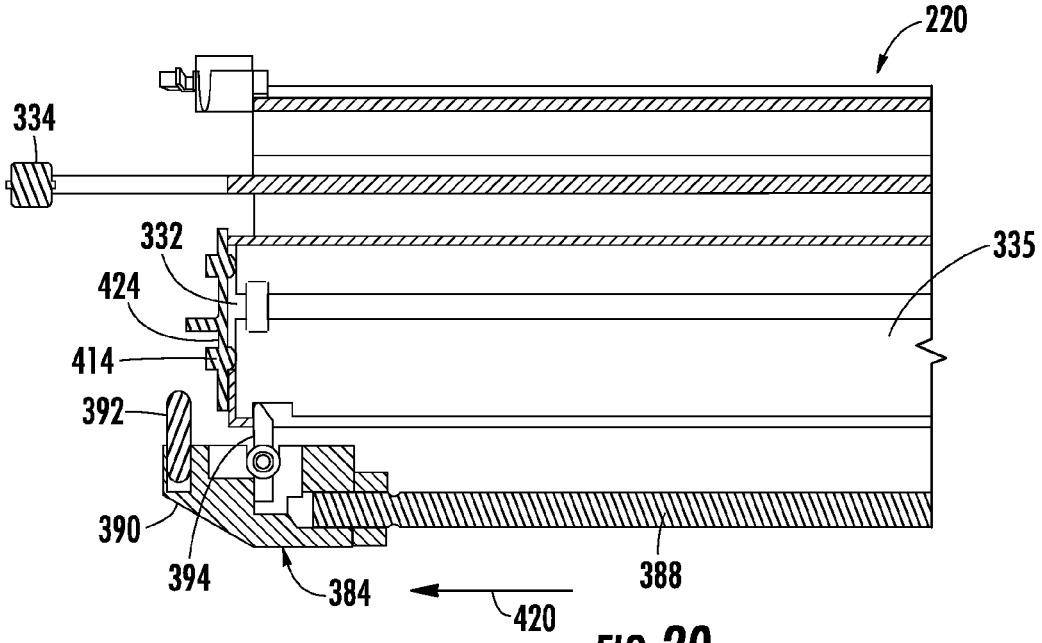
FIG. 20 is a sectional view of the capsule loader/unloader of FIG. 19 illustrating pushing of the capsule to a completely inserted position.

As shown by FIG. 19, capsule 335 includes a latch detent 414. Manual insertion of capsule 335 through guide opening 410 may continue until end 416 of capsule 435 abuts stopper 392, at which point detent 414 is aligned with an end of latch 394. In response to an inputted command from the person loading capsule 335 to complete the insertion process or in response to a signal from a sensor sensing the positioning of capsule 335, controller 274 generates control signals causing cylinder-piston assembly 382 to extend piston 388 to move piston 338 in the direction indicated by arrow 420. As a result, latch 394 pivots into reception within the detent 414 and pushes capsule 335 in the direction of arrow 420 further into capsule chamber 332 until fully inserted. Such full insertion may achieved by providing piston 388 with a predefined maximum extension length or by sensing the position of capsule 335 such as with a contact sensor or switch 424.

Figure 21:
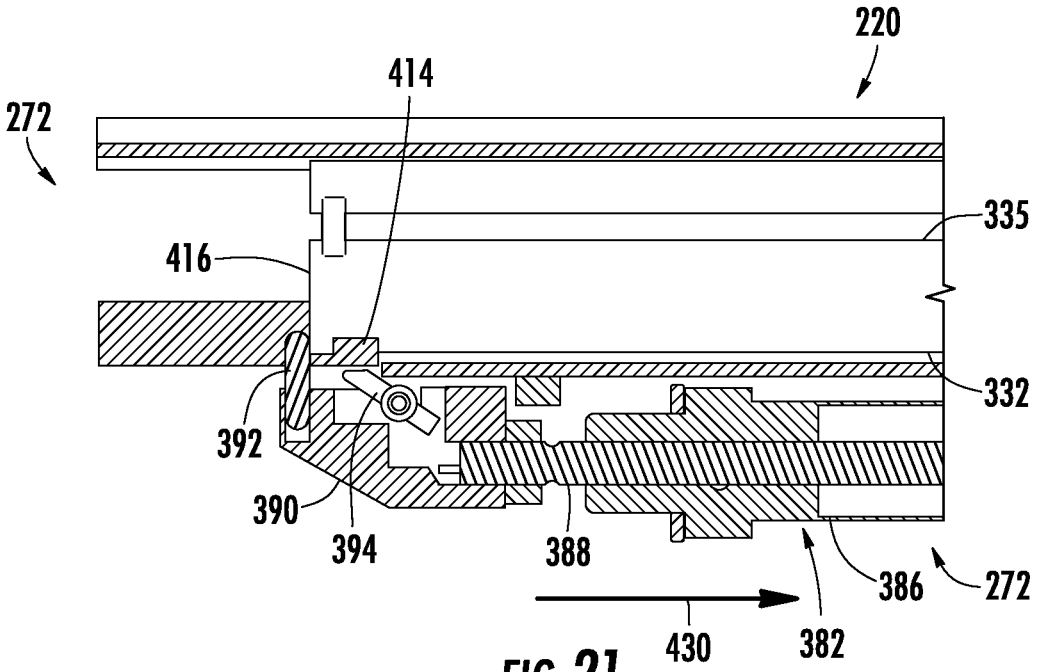
FIG. 21 is a sectional view of the capsule loader/unloader of FIG. 13 during initial extraction of a capsule.

FIG. 21 illustrates the reverse operation, the initial extraction of capsule 335, such as after capsule 335 has been emptied. As shown by FIG. 21, in response to an extraction command received through the keypad or other interface, controller 274 generates control signals directing cylinder-piston assembly 382 to retract piston 388 in the direction indicated by arrow 430. As a result, latch 394 pivots out of detent 414 and stopper 392 presses against axial and 416 of capsule 335 to move capsule 335 in the direction indicated by arrow 430 and out guide opening 410 (shown in FIG. 17). Once projecting through access opening 410, capsule 335 may be manually grasped and withdrawn.

Figure 22:
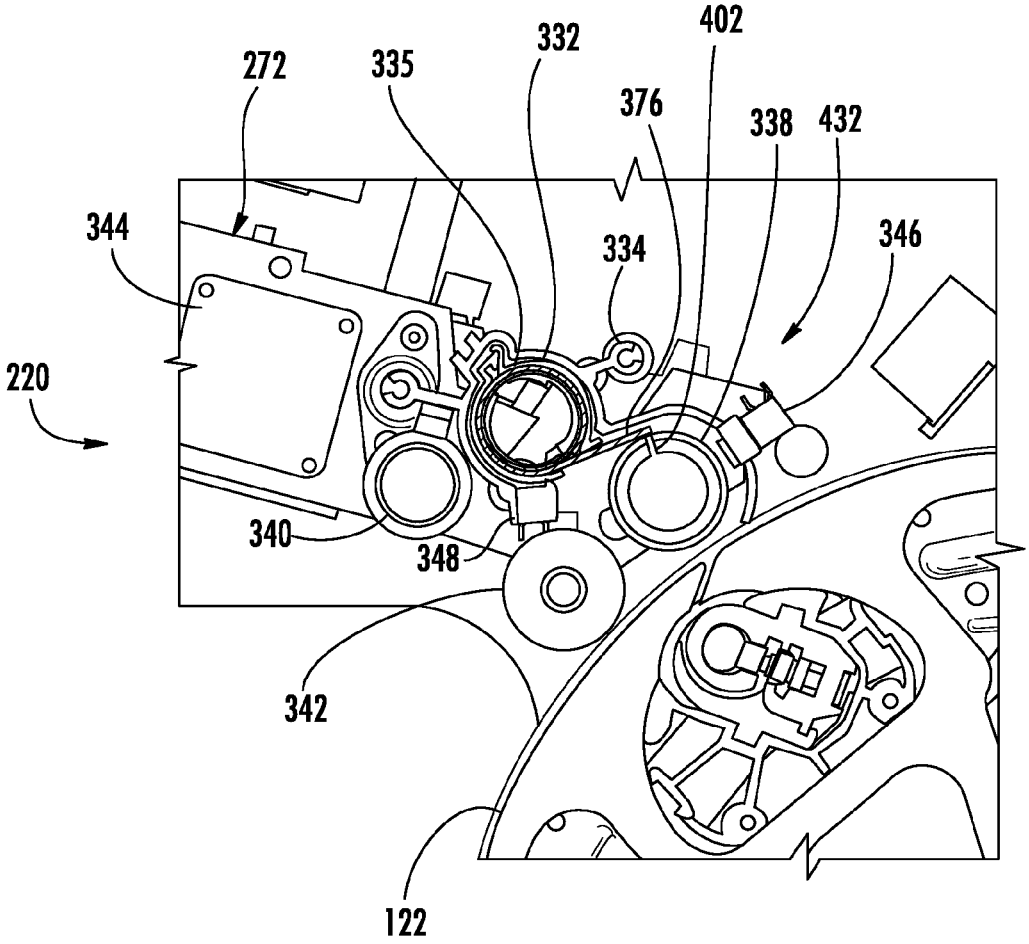
FIG. 22 is a sectional view of the printing system of FIG. 4 illustrating the foil remover/applicator in an example foil applying position.

FIGS. 22-29 illustrate an example operation for loading or applying photoconductive foil sheet 360 about drum 122. As shown by FIG. 22, in response to commands entered by a user interface, controller 274 generates control signals directing motor 308 to drive shuttle belts 314 to move the loaded foil applicator/remover 272 to the loading or applying position 432. During such movement, cam follower 334 and cam surface 320 to cooperate to gently position and lower pickup roller 338 and pressing roller 342, both of which are at a nose of remover/applicator 272, into close proximity with drum 122. As further shown by FIG. 22, upon being loaded into capsule chamber 332, a leading edge 376 of backing sheet 362 projects out of capsule 335 and across vacuum port 402 of pickup roller 338. Such positioning is facilitated by extension portion 412 of guide opening 410 shown in FIGS. 17 and 18.

Figure 23:
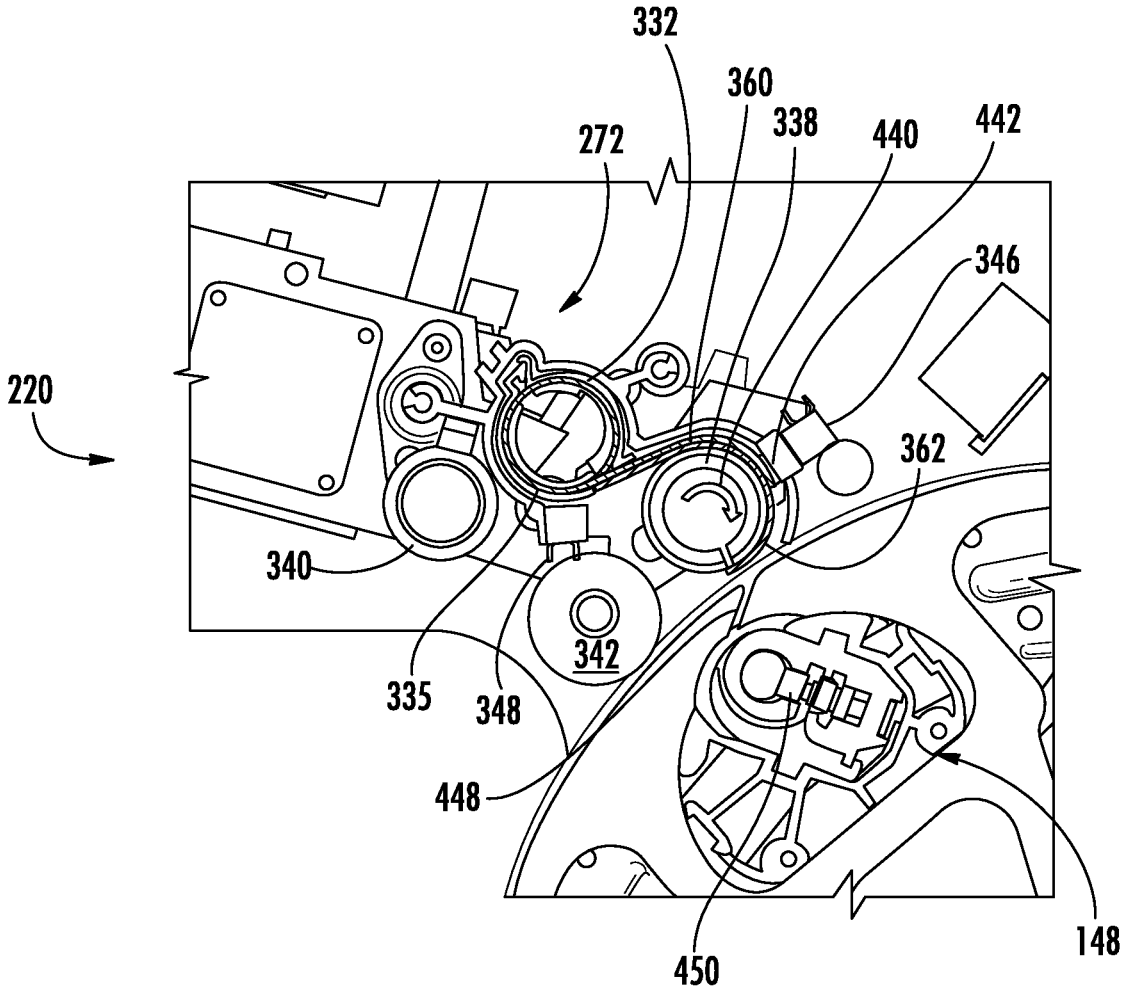
FIG. 23 is a sectional view of the printing system of FIG. 22 illustrating unwinding of a backing sheet from a loaded capsule.

As shown in FIG. 23, in response to receiving signals from sensors 316 that remover/applicator 272 is properly deployed in the applying position (or possibly in response to an additional confirmation input or command from a person), controller 274 generates control signals directing vacuum source 340 to apply a vacuum through vacuum port 402 such that pickup roller 338 grips leading edge 376 of backing sheet 362. Thereafter, controller 274 generates control signals directing step motor 344 to drive pickup roller 338 in the direction indicated by arrow 440. During such rotation, that sheet 362 is held by the vacuum through vacuum port 402 against pickup roller 338 and winds about pickup roller 338. During such rotation, the leading edge 442 of photoconductive foil sheet 360 being carried by backing sheet 362 passes opposite to sensor 346, providing controller 274 with the location of leading edge 442. As further shown by FIG. 23, controller 274 generates control signals directing rotary actuator 147 (shown in FIG. 3) to position drum 122 such that opening 448 for foil holder 148 (comprising a powered set of foil pinchers or clamps 450) is located to extend tangentially to pick up roller 338 for the reception of leading edge 442 of foil 360.

Figure 24:
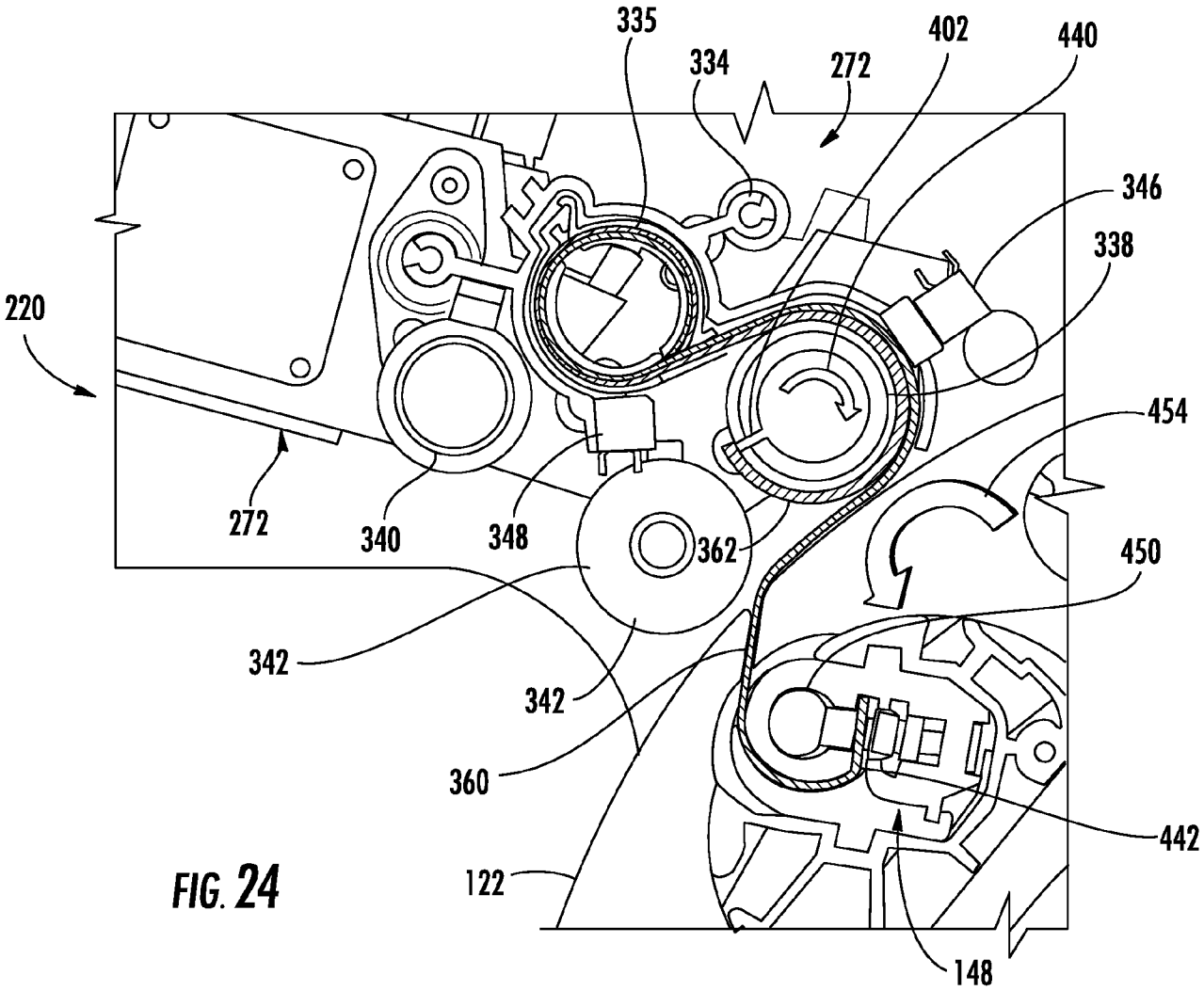
FIG. 24 is a sectional view of the printing system of FIG. 23 illustrating unwinding of the photoconductive foil sheet onto a drum.

As shown by FIG. 24, the pick up roller 338 is rotationally driven to position leading edge 442 of foil sheet 360 through opening or passage 448 (shown in FIG. 23) to between pinchers 450 which are actuated to clamp or grip about leading edge 442. Upon receiving signals from one or more sensors of foil holder 148 indicating that leading edge 442 of foil sheet 360 has been gripped by foil holder 148, controller 274 generates control signals directing rotary actuator 147 (shown in FIG. 3) to rotate drum 122 in the direction indicated by arrow 454. As a result, foil sheet 360 is wrapped about drum 122 while backing sheet 362 is wound multiple times about pickup roller 338. Continued rotation of drum 122 results in pressing roller 342 pressing foil sheet 362 against drum 122. Such rotation of drum 122 and pick up roller 338 continues until both sheet 360 has been completely applied to drum 162. In one implementation, sensor 346 may sense the trailing edge of foil sheet 362 to further confirm that follow sheet 360 has been completely discharged from remover/applicator 272 and onto drum 122.

Figure 25:
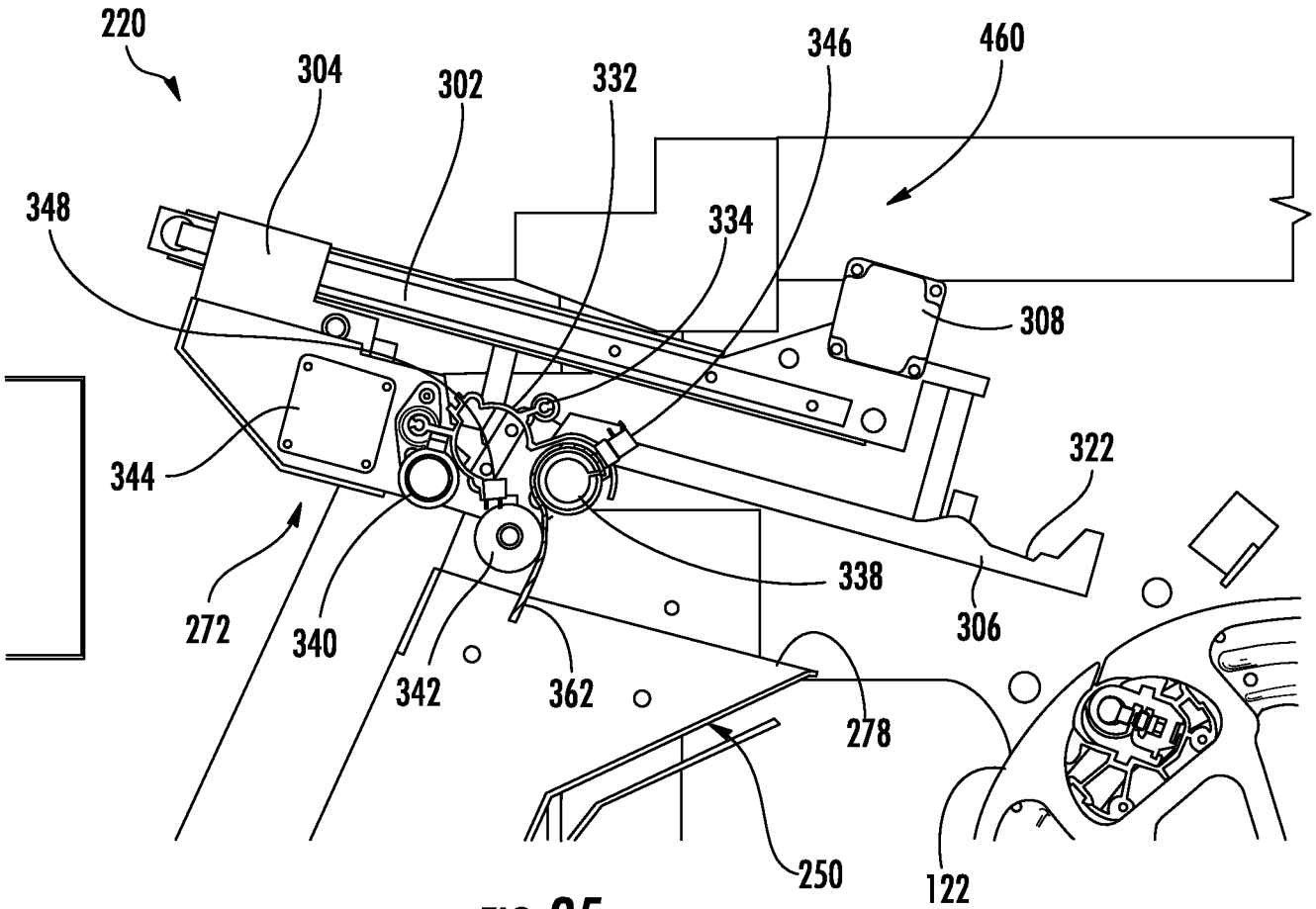
FIG. 25 is a sectional view of the printing system of FIG. 4 illustrating the foil remover/applicator at an example discharge position.
Figure 26:
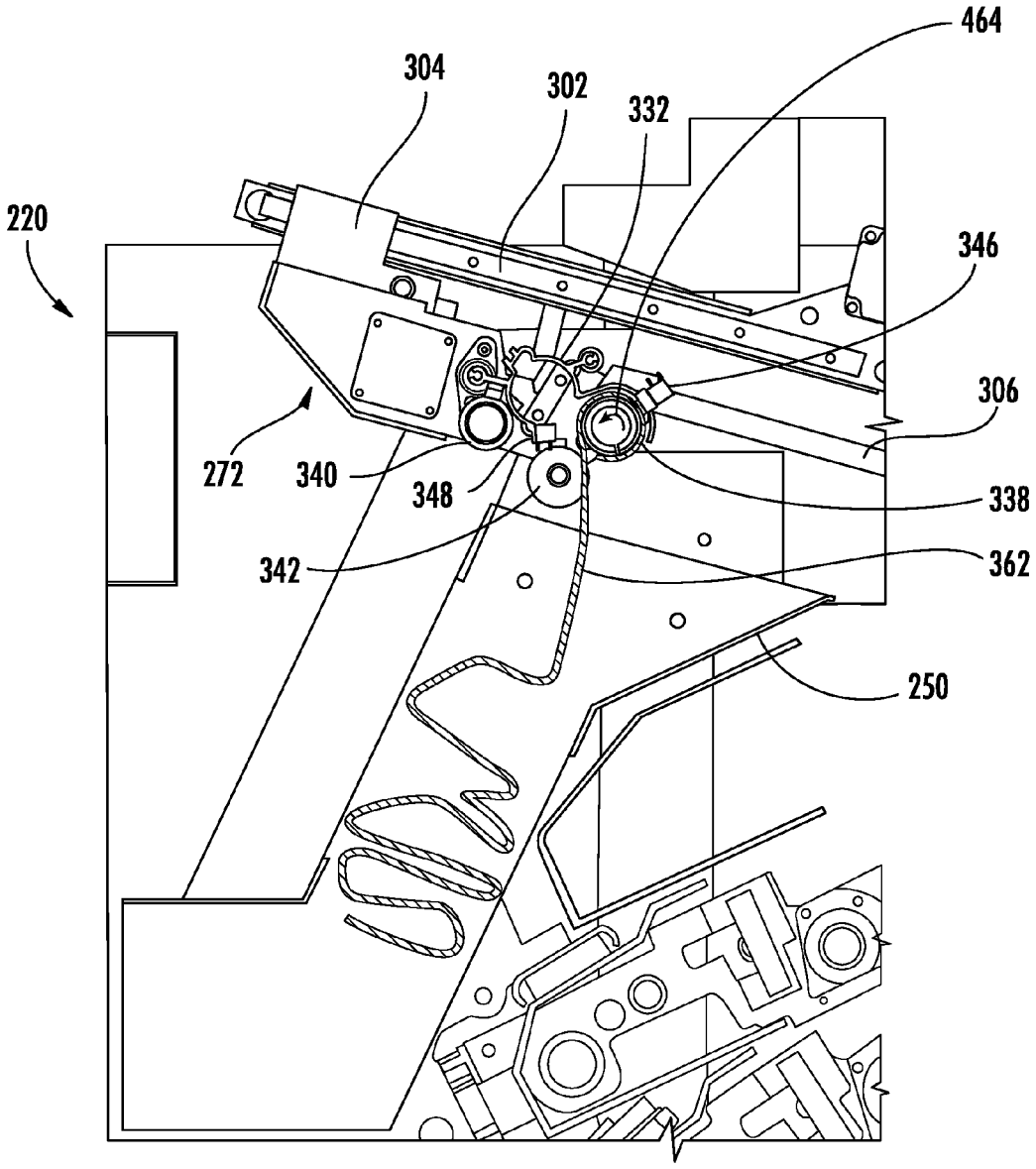
FIG. 26 is a sectional view of the printing system of FIG. 25 illustrating discharge of the backing sheet into a trash bin.
Figure 30:
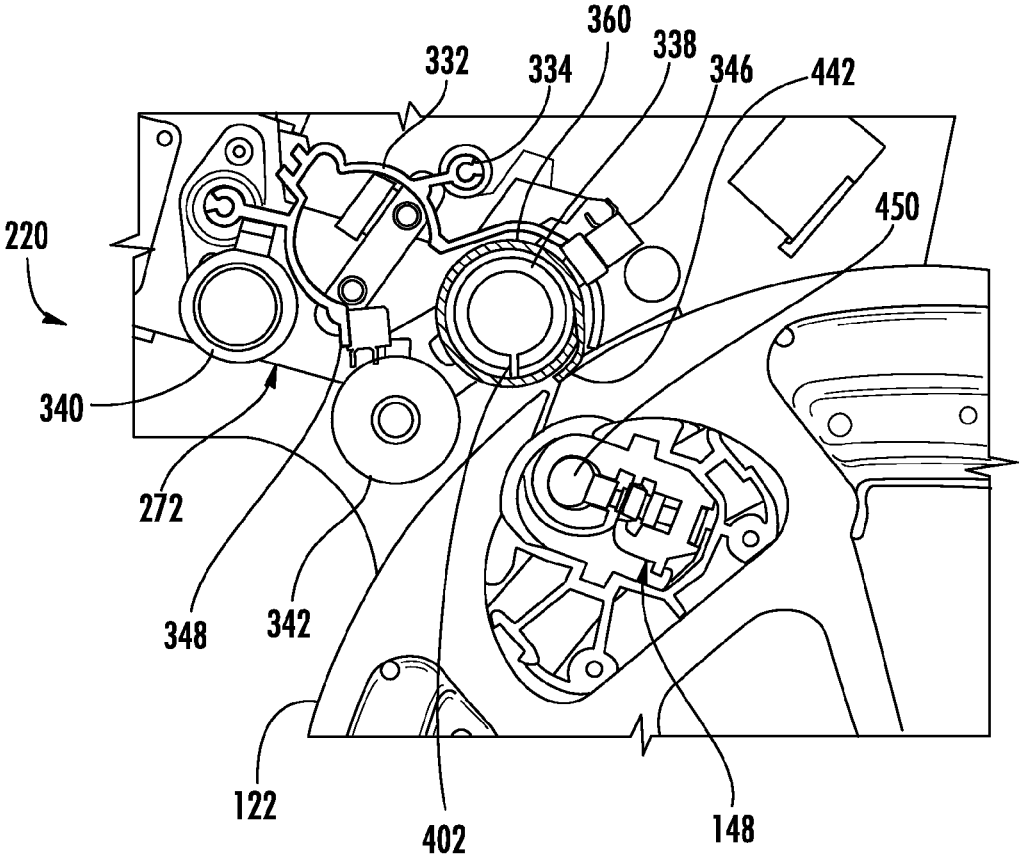
FIG. 30 is a sectional view of the printing system of FIG. 29 illustrating completion of removal of the existing photoconductive foil from the drum.

FIGS. 25 and 26 illustrates an example operation for discharging backing sheet 362 from remover/applicator 272. As shown by FIG. 30, after or in response to the complete application of foil sheet 362 drum 122, controller 274 generates control signals directing motor 308 to move remover/applicator 272 from the applying position 432 (shown in FIG. 22) to the discharging or unloading position 460. In the unloading position, pick up roller 338 is located above opening 278 of trash bin 250. Once controller 274 detects that remover/applicator 272 is properly positioned above trashbin 250 as indicated by sensors 316, controller 274 generates control signals directing motor 344 to rotate pick up roller 338 in a reverse direction as indicated by arrow 464 in FIG. 26. This results in backing sheet 362 being discharged into trash bin 250. Such reverse rotation of pickup roller 338 continues until backing sheet 362 has been completely discharged as indicated by signals from sensor 348 sensing the trailing edge of backing sheet 362.

Figure 27:
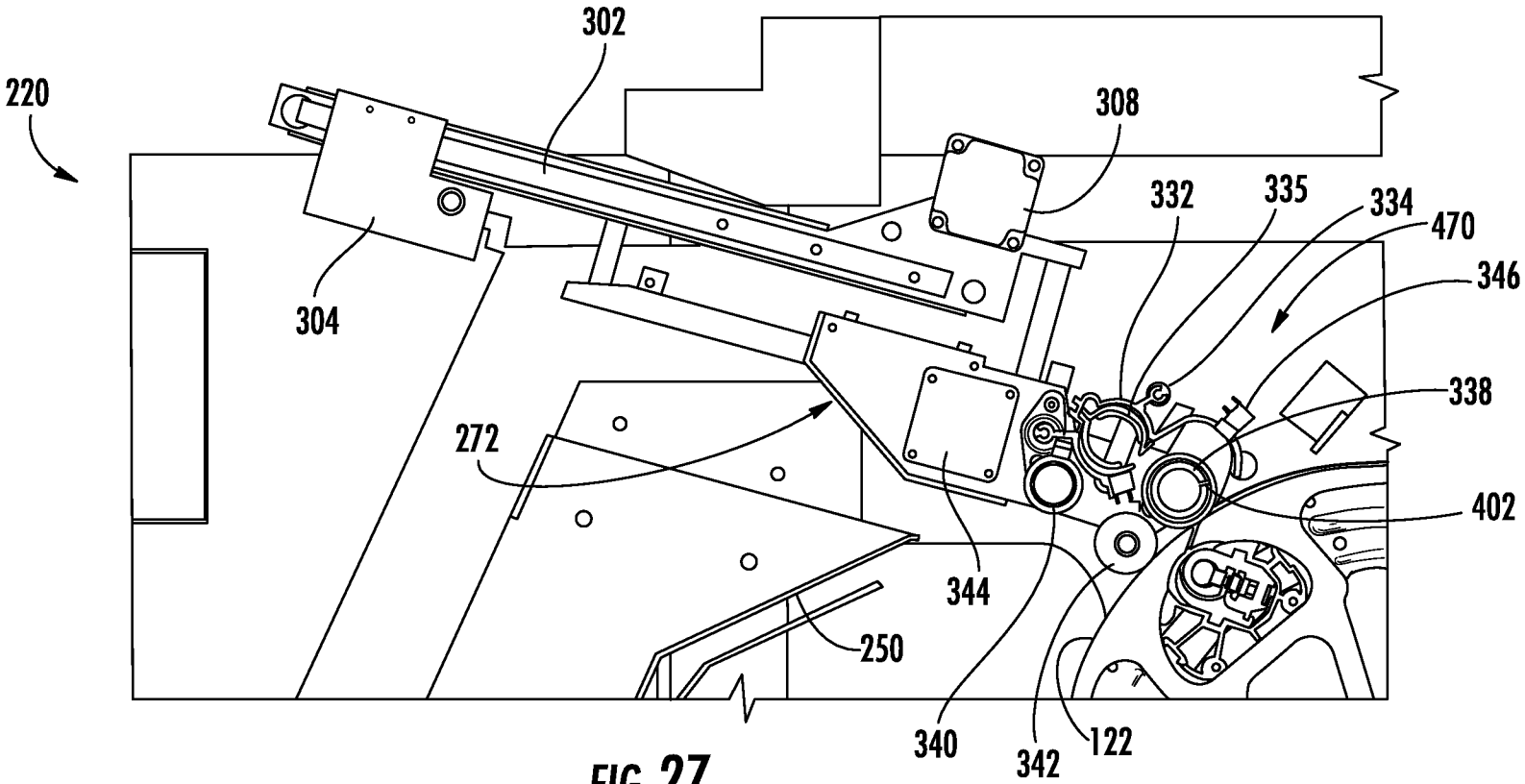
FIG. 27 is a sectional view of the printing system of FIG. 4 illustrating the foil remover/applicator at an example removing position.

FIGS. 27-30 illustrate an example operation for withdrawing or removing a photoconductive foil sheet 360 from drum 122. As shown by FIG. 27, in response to receiving an input command through a user interface such as a touchpad or the like, or in response to determining that the existing foil sheet 360 should be replaced, controller 274 generates control signals causing motor 308 to drive shuttle belts 314 to move remover/applicator 272 to the removing position 470 (as indicated from sensor 316) in which pick up roller 338 extends in a close proximity with the circumferential surface of drum 122.

Figure 28:
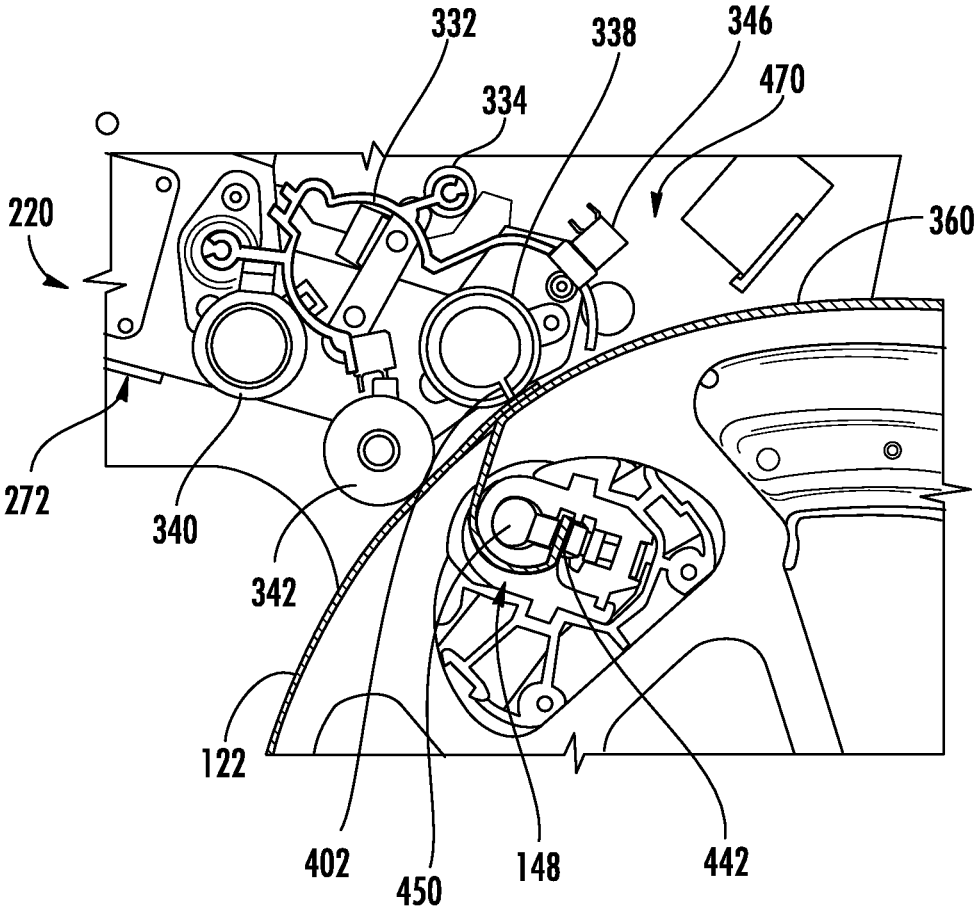
FIG. 28 is a sectional view of the printing system of FIG. 27 illustrating gripping of an existing photoconductive foil sheet on drum by the example foil remover/applicator.

As shown by FIG. 28, once remover/applicator 272 is in the removing position 470, controller 274 generates control signals directing vacuum source 342 to apply a vacuum through ports 402 so as to grip the existing foil sheet 360 on drum 122.

Figure 29:
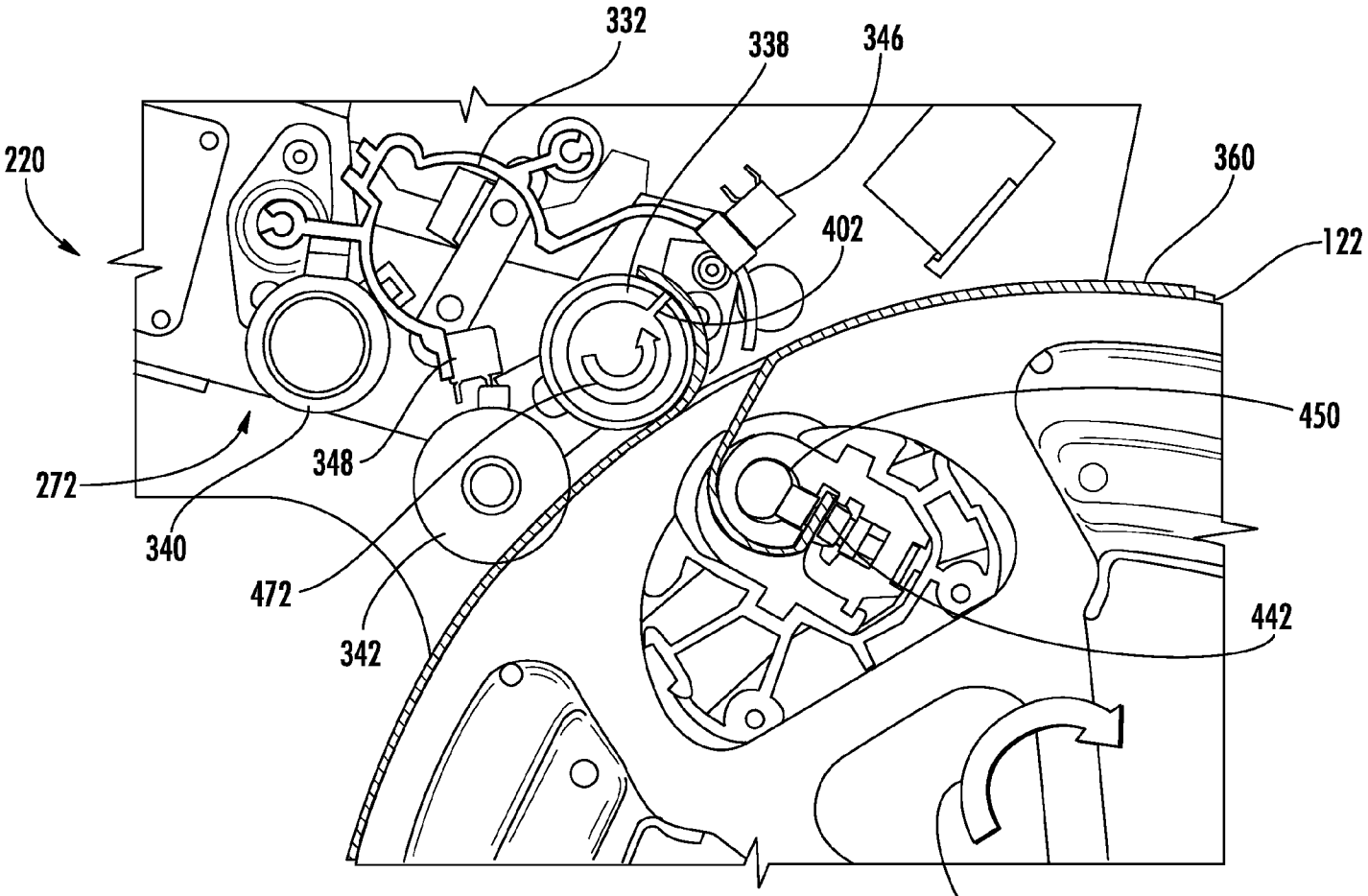
FIG. 29 is a sectional view of the printing system of FIG. 28 illustrating removal of the existing photoconductive foil sheet from drum.

As shown by FIG. 29, controller 274 further generates control signals directing motor 344 to rotate pick up roller 338 in the direction indicated by arrow 472. Controller 274 also generates control signals directing rotary actuator 147 (shown in FIG. 3) to rotate drum 122 in the direction indicated by arrow 474. As a result, the existing foil sheet 360 is withdrawn from drum 122 and wrapped multiple times, overlapping itself multiple times, about pickup roller 338. In the example implementation, during such removal, pinchers 450 continue to grip leading-edge 442 of foil sheet 360 such that follow sheet 360 is wrapped about pickup sheet 338 with tension for a tight wrap. As shown by FIG. 30, pinchers 450 release the previously leading-edge 442 of foil sheet 360 near the end of a complete revolution of drum 122 to allow pick up roller 338 to completely separate the previous foil sheet 360 from drum 122.

Figure 31:
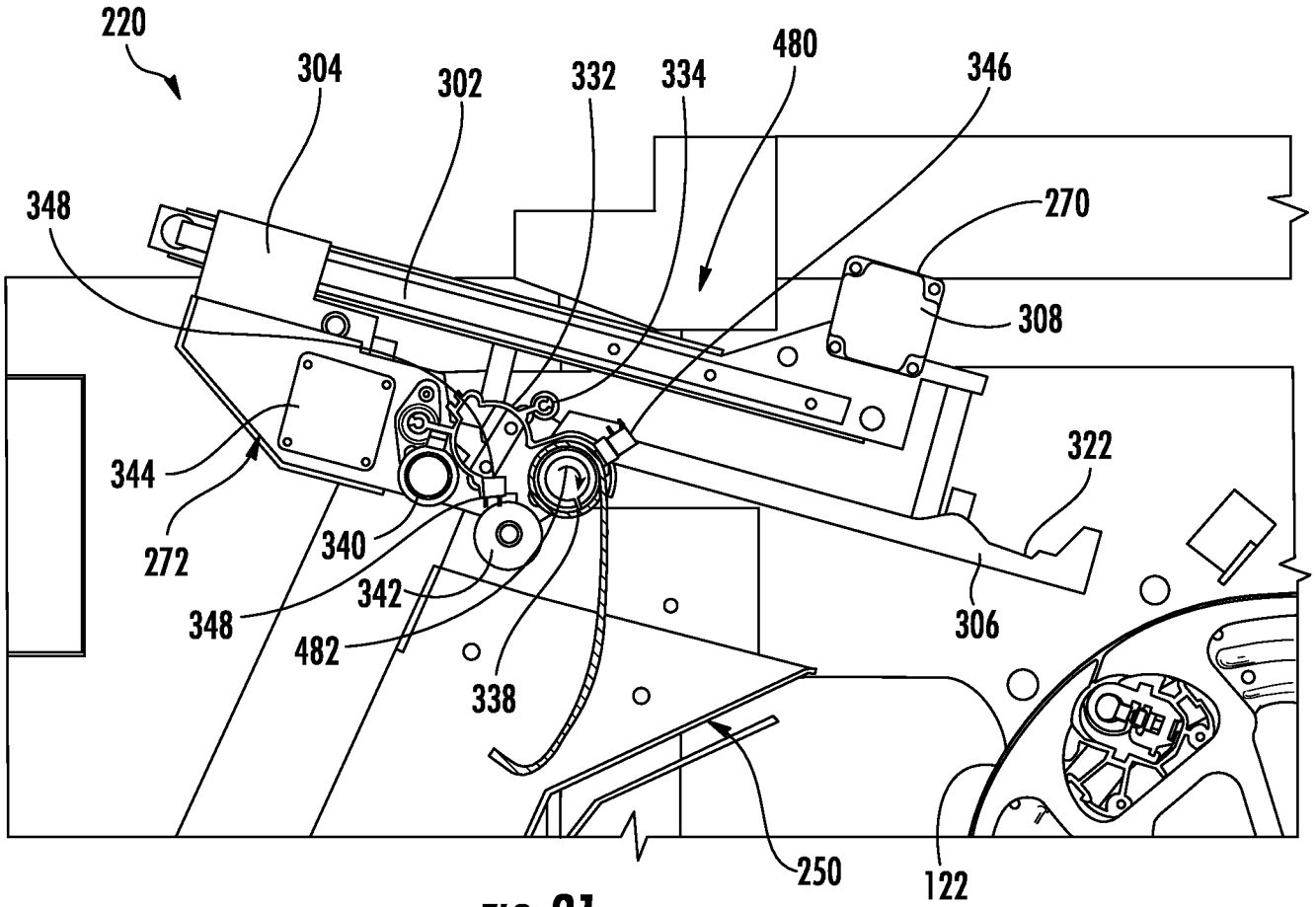
FIG. 31 is a sectional view of the printing system of FIG. 4 illustrating the foil remover/applicator at the discharge position while discharging the removed photoconductive foil sheet.

FIG. 31 illustrates one example operation for discharging the photoconductive foil sheet 360 from pick up roller 338. As shown by FIG. 31, in response to the foil sheet 360 being completely removed from drum 122 (based upon the completion of the revolution of drum 122 during such removal or based upon sensing of edge 442 by optical sensor 346), controller 274 generates control signals directing motor 308 to move remover/applicator 272 from the removing position for 70 (shown in FIG. 27) to the discharging or unloading position 480. In the discharging position, pick up roller 338 is located above opening 278 of trash bin 250. Once controller 274 detects that remover/applicator 272 is properly positioned above trash bin 250 as indicated by sensors 316, controller 274 generates control signals directing motor 344 to rotate pick up roller 338 in a forward direction as indicated by arrow 482 in FIG. 31. This results in the wound foil sheet 360 being unwound into trash bin 250. Such rotation of pickup roller 338 continues until the wound foil sheet 360 has been completely discharged as indicated by signals from sensor 348 sensing the trailing edge of foil sheet 360.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a rotatable support; and a photoconductive foil sheet applicator to apply a photoconductive foil sheet having a leading edge and a trailing edge about an exterior of the rotatable support such that both the leading edge and the trailing edge are released from the photoconductive foil sheet applicator and are concurrently carried by the rotatable support.

2. The apparatus of claim 1 further comprising a shuttle carrying the photoconductive foil sheet applicator and is movable between a sheet applying position in which the photoconductive foil sheet applicator is adjacent and opposite to the rotatable support to apply the photoconductive foil sheet to the rotatable support and the sheet loading position away from the rotatable support to load the photoconductive foil sheet into the shuttle.

3. The apparatus of claim 2 further comprising a capsule chamber carried by the shuttle to receive a capsule containing the photoconductive foil sheet.

4. The apparatus of claim 3 further comprising a capsule loader-unloader carried by the shuttle to move the capsule between a fully loaded position within the capsule chamber and a partially loaded position within the capsule chamber.

5. The apparatus of claim 3 wherein the foil sheet applicator is configured to draw the photoconductive foil sheet from the capsule and apply the photoconductive foil sheet about the rotatable support.

6. The apparatus of claim 5, wherein the foil sheet applicator comprises a roller about which the photoconductive foil sheet is to wrap during application of the photoconductive foil sheet about the rotatable support.

7. The apparatus of claim 6 further comprising a vacuum source to apply a vacuum to a surface of the roller.

8. The apparatus of claim 3 further comprising the capsule, the capsule comprising a tubular member to contain the photoconductive foil sheet.

9. The apparatus of claim 1 further comprising the photoconductive foil sheet and a backing sheet, wherein the photoconductive foil is releasably held and carried by the backing sheet.

10. The apparatus of claim 9, wherein the photoconductive foil applicator comprises a roller about which the backing is wrapped as the photoconductive foil sheet is being separated from the backing and being applied about the rotatable support.

11. The apparatus of claim 1, wherein the photoconductive foil sheet applicator comprises a roller to peel a backing sheet from the photoconductive foil sheet while the photoconductive foil sheet is being wrapped about the rotatable support by the roller.

12. The apparatus of claim 11, wherein the roller is configured to wind the backing sheet greater than 360 degrees about the roller as a photoconductive foil sheet is wrapped about the rotatable support.

13. The apparatus of claim 12, wherein the roller is configured to wind the photoconductive foil sheet greater than 360 degrees about the roller during removal of the photoconductive foil sheet from the rotatable support.

14. The apparatus of claim 1, wherein the photoconductive foil sheet applicator is to apply the photoconductive foil sheet about the circumference of the rotatable support such that the photoconductive foil sheet completely wraps around the rotatable support.

15. The apparatus of claim 1, wherein the rotatable support comprises a drum.

16. An apparatus comprising:

a tubular capsule;

a photoconductive foil sheet; and a backing sheet releasably adhered to and carrying the photoconductive foil sheet, the backing sheet and the photoconductive foil sheet being rolled within the tubular capsule with the backing sheet projecting from the tubular capsule.

17. The apparatus of claim 16, wherein the backing sheet and the photoconductive foil sheet are wound into a cylinder in multiple overlapping cylindrical wraps and wherein the backing sheet has a leading edge portion projecting from the tubular capsule and extending beyond the photoconductive foil sheet.

18. A method comprising:

loading a photoconductive foil sheet adjacent a photoconductive foil sheet applicator;

wrapping the photoconductive foil sheet about a drum with the photoconductive foil sheet applicator; and forming electrostatic image on the photoconductive foil sheet, wherein the photoconductive foil sheet applicator comprises a roller, wherein the photoconductive foil is releasably supported and carried by a backing sheet and wherein the method further comprises wrapping the backing sheet greater than 360 degrees about the roller as the photoconductive foil sheet is wrapped about the drum.

19. The method of claim 18, wherein the loading comprises loading a cylindrical capsule carrying the photoconductive foil sheet in a rolled state.

20. The method of claim 18 further comprising removing the photoconductive foil sheet from about the drum while wrapping the photoconductive foil sheet greater than 360 degrees about the roller.

* * * * *